US008627672B2

(12) United States Patent
Moteki et al.

(10) Patent No.: US 8,627,672 B2
(45) Date of Patent: Jan. 14, 2014

(54) WALL-HUNG AIR CONDITIONER AND INSTALLING DEVICE FOR AIR CONDITIONER

(75) Inventors: Yasuhiro Moteki, Oura-gun (JP); Yasunori Ohama, Ota (JP); Mayumi Saito, Ota (JP); Tomohiro Tabata, Oura-gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 652 days.

(21) Appl. No.: 12/860,105

(22) Filed: Aug. 20, 2010

(65) Prior Publication Data

US 2011/0048050 A1 Mar. 3, 2011

(30) Foreign Application Priority Data

| | | |
|---|---|---|
| Aug. 27, 2009 | (JP) | 2009-196345 |
| Aug. 27, 2009 | (JP) | 2009-197056 |
| Aug. 31, 2009 | (JP) | 2009-199297 |
| Oct. 21, 2009 | (JP) | 2009-242195 |

(51) Int. Cl.
*F25D 23/12* (2006.01)

(52) U.S. Cl.
USPC ..... 62/263; 62/298

(58) Field of Classification Search
USPC ..... 62/263, 262, 259.1, 297, 298, 302; 312/101, 245; 29/428, 892.1
See application file for complete search history.

(56) References Cited

U.S. PATENT DOCUMENTS

| | | | | | |
|---|---|---|---|---|---|
| 3,740,964 | A * | 6/1973 | Herweg | 62/262 |
| 3,777,506 | A * | 12/1973 | Hergatt et al. | 62/237 |
| 4,507,940 | A * | 4/1985 | Sato et al. | 62/407 |
| 4,694,736 | A * | 9/1987 | Yamagata et al. | 454/187 |
| 4,958,500 | A * | 9/1990 | Kuroda et al. | 62/89 |
| 4,970,874 | A * | 11/1990 | Solak et al. | 62/258 |
| 5,038,577 | A * | 8/1991 | Stanford | 62/262 |
| 5,046,327 | A * | 9/1991 | Walker et al. | 62/244 |
| 5,081,849 | A * | 1/1992 | Thompson et al. | 62/262 |
| 6,172,748 | B1 * | 1/2001 | Sones et al. | 356/237.1 |
| 6,446,455 | B1 * | 9/2002 | Sohn et al. | 62/298 |
| 6,758,742 | B2 * | 7/2004 | Farag et al. | 454/156 |
| 7,398,654 | B2 * | 7/2008 | Choi et al. | 62/285 |

FOREIGN PATENT DOCUMENTS

| | | |
|---|---|---|
| JP | 56-010216 | 7/1954 |
| JP | 62-117429 U | 7/1987 |
| JP | 02-064822 U | 5/1990 |
| JP | 06-213470 A | 8/1994 |
| JP | 06-241493 | 8/1994 |
| JP | 08-114352 A | 5/1996 |
| JP | 08-226698 A | 9/1996 |
| JP | 09-310882 A | 12/1997 |

(Continued)

*Primary Examiner* — Mohammad M Ali
(74) *Attorney, Agent, or Firm* — McDermott Will & Emery LLP

(57) ABSTRACT

In a wall-hung air conditioner 1 provided with a vertical blade 85 for wind-direction change, a flap 60, and a fan guard 70 at an outlet 13 of a housing containing a heat exchanger 2 and a blower, the fan guard 70 is provided with a plurality of wires 71 extending in the longitudinal direction of the outlet 13 and a pair of supporting bodies 72 and 73 bundling the both ends of the wires 71, and the fan guard 70 is installed with the plurality of wires 71 extended into a space between the vertical blade 85 and the flap 60 and the pair of the supporting bodies 72 and 73 are fixed and mounted onto the outlet 13 through one-touch operation.

25 Claims, 28 Drawing Sheets

(56) References Cited

FOREIGN PATENT DOCUMENTS

| | | | |
|---|---|---|---|
| JP | 10-073278 | A | 3/1998 |
| JP | 10-132318 | A | 5/1998 |
| JP | 11-083070 | A | 3/1999 |
| JP | 2009-058138 | A | 3/2009 |
| JP | 2009-074749 | | 4/2009 |
| JP | 2009-139080 | A | 6/2009 |
| JP | 4285586 | | 6/2009 |
| JP | 2009-156490 | | 7/2009 |

* cited by examiner

WALL-HUNG AIR CONDITIONER AND INSTALLING DEVICE FOR AIR CONDITIONER

INCORPORATION BY REFERENCE

The present application claims priority under 35 U.S.C. §119 to Japanese Patent Application No. 2009-196345 filed on Aug. 27, 2009, Japanese Patent Application No. 2009-199297 filed on Aug. 31, 2009, Japanese Patent Application No. 2009-242195 filed on Oct. 21, 2009 and Japanese Patent Application No. 2009-197056 filed on Aug. 27, 2009. The content of the applications is incorporated herein by reference in its entirety.

BACKGROUND OF INVENTION

1. Field of Invention

The present invention relates to a wall-hung air conditioner and an installing device for an air conditioner.

2. Description of Related Art

There is known that an air conditioner is provided with a fan guard at an outlet in order to prevent the hand from inserting from the outlet of an indoor unit (See U.S. Pat. No. 4,285,586, for example). The fan guard is configured so as to be provided with wires extending in the longitudinal direction of the outlet and to support the middle or both ends of the wires. Since the fan guard is desired to maintain a state in which the hand cannot be inserted into the outlet of the indoor unit even if an external force is applied thereto, in a configuration described in U.S. Pat. No. 4,285,586, both ends of a plurality of wires are inserted and attached to supporting portions provided in the air conditioner, and spacers clipping the wires is provided.

However, since the fan guard of the prior art supports the wires against the external force and adopts a complicate structure, many manufacturing-hours are required and it is difficult to increase production efficiency and reduce the cost.

A wall-hung air conditioner mounted on a wall face or the like in a room to be air-conditioned has been known (See Japanese Patent Laid-Open No. 2009-156490, for example). This type of wall-hung air conditioners include those in which a frame is fixed to an installation plate fixed to the wall face, devices such as a blower, a heat exchanger and the like are fixed to the frame, and a grill is fixed to the frame so as to cover the heat exchanger.

In such the wall-hung air conditioner, fixation of the frame to the installation plate so that a gap between the installation plate and the frame becomes small and firm fixation of the grill to the frame have been strongly required.

Also, a wall-hung air conditioner in which one indoor unit is connected to one outdoor unit and an operation state of the outdoor unit is controlled according to a set temperature, a room temperature and the like has been known. In the indoor unit, a control substrate for operation control of the indoor unit while communicating with the outdoor unit is disposed. The control substrate is contained in an electric equipment box, and a terminal block that connects a communication wiring from the outdoor unit to the control substrate is disposed in the electric equipment box (See Japanese Patent Laid-Open No. 2009-74749, for example). Moreover, a wall-hung air conditioner in which a plurality of indoor units are connected to one or a plurality of outdoor units and the operation state of the one or the plurality of outdoor units is controlled by a central controller according to an operation state of each indoor unit is also known. In this type of wall-hung air conditioners, in the indoor unit, in addition to the above control substrate as a main substrate, a control substrate for central controller that communicates with the central controller and provides a control signal from the central controller to the main substrate is disposed as a sub substrate.

If a component corresponding to an optional specification such as the sub substrate or the like is added to the indoor unit or a component is replaced during maintenance, specification change or the like, a terminal block attached to the component needs to be newly disposed in the electric equipment box and various wiring connections need to be made. However, the indoor unit of the wall-hung air conditioner is arranged close to a ceiling face in a room or the like. Therefore, when a component is to be added or replaced for the indoor unit having been already installed, various wiring connections for the component addition or replacement should be performed at a high place, and workability is poor and reliable performance of various wiring connections is difficult.

If an indoor unit of a split air conditioner is to be installed on an indoor wall face, an installation plate is mounted on the wall face, and an installation position of the indoor unit and taken-out positions of a refrigerant pipeline and a drain pipeline from the indoor unit to the outside of the room are determined by an indication shown on the installation plate (See Japanese Patent Laid-Open No. H06-241493, for example).

Then, after the upper part of the indoor unit is hooked to the installation plate, a supporting member is sandwiched between the installation plate and the indoor unit and the upper part of the indoor unit is flipped up so as to ensure a working space in the lower part of the indoor unit so that a wiring work is performed so as to connect a refrigerant pipeline from the outdoor unit and the refrigerant pipeline from the indoor unit.

However, if the installation position of the indoor unit is close to the ceiling of the room, the supporting member is sandwiched, and then the upper part of the indoor unit touches the ceiling, and the indoor unit cannot be fixed in the flip-up state in some cases. In this case, another article (an unnecessary packing material, for example) is sandwiched between the installation plate and the indoor unit so as to ensure the working space and the piping work is performed, but it is likely that the packing material is displaced during the work and that might badly affect the work.

SUMMARY OF INVENTION

The present invention is was made in view of the above circumstances and has an object to provide a configuration in an air conditioner having an fan guard so as to be able to support and easily mount wires of the fan guard against an external force.

In order to achieve the above object, in a wall-hung air conditioner comprising a vertical blade and a lateral blade for wind-direction change and a fan guard at an outlet of a housing containing a heat exchanger and a blower, the fan guard is provided with a plurality of wires extending in the longitudinal direction of the outlet and a pair of supporting bodies bundling the both ends of the wires, and the fan guard is installed with the plurality of wires extended into a space between the vertical blade and the lateral blade and the pair of supporting bodies fixed into the outlet through one-touch operation.

According to this configuration, the wires extending in the longitudinal direction of the outlet are bundled by the pair of supporting bodies, and the supporting bodies are installed into the outlet through one-touch operation, and the fan guard can be easily mounted at the outlet. Also, by extending the wires in the space between the vertical blade and the lateral blade, it becomes difficult to drop the wires by an external force or to move them to the depth or the front of the outlet, and the wires can be supported against the external force and a state in which the hand cannot be inserted into the outlet can be maintained.

In the above configuration, a support may be extended between an upper edge portion and a lower edge portion of the outlet, and the plurality of wires maybe locked to a receiving groove of the support.

In this case, since the wires are locked by the receiving groove of the support extended between the upper edge portion and the lower edge portion of the outlet, the wires can be supported against the external force more strongly.

Also, in the above configuration, the receiving groove of the support maybe configured to be exposed to the front face side of the outlet.

In this case, since the wires can be locked to the receiving groove of the support from the front face side, the fan guard can be mounted more easily.

Moreover, in the above configuration, it may be so configured that the supporting bodies are mounted between the upper edge portion and the lower edge portion of the outlet by elastically deforming either one of the upper edge portion or the lower edge portion.

In this case, the supporting bodies can be mounted easily at the outlet through one-touch operation, and the supporting bodies can be reliably fixed by an elastic force of the upper edge portion or the lower edge portion after the mounting.

Furthermore, in the above configuration, it may be so configured that a projection is formed at either one of an upper end or a lower end of the supporting body, a plate-shaped portion is formed on the other, a hole engaged with the projection is formed in either one of the upper edge portion or the lower edge portion of the outlet, and a receiving portion that supports the plate-shaped portion is formed on the other.

In this case, by elastically deforming the upper edge portion or the lower edge portion of the outlet, the supporting body can be easily mounted at the outlet through one-touch operation.

Also, in the above configuration, a wire receiving portion that regulates movement in either of upward or downward direction or in both the upward and downward directions of the wire may be disposed on the vertical blade.

In this case, since the movement of the wire in either of upward or downward direction or in both the upward and downward directions is regulated by the vertical blade, the wire can be supported against the external force more reliably and the state in which the hand cannot be inserted into the outlet can be maintained.

According to the present invention, the fan guard can be easily attached to the outlet, and after the attachment, the wire can be supported against the external force, and the state in which the hand cannot be inserted into the blower (cross-flow fan) located inside the outlet can be maintained.

The present invention was made in view of the above circumstances and has an object to provide a wall-hung air conditioner having a structure in which a frame is fixed to an installation plate and a grill is fixed to the frame, in which the frame can be fixed to the installation plate so that a gap between the installation plate and the frame becomes small and the grill can be firmly fixed to the frame without increase in the number of components or deterioration in designability.

In order to achieve the above object, the present invention is, in a wall-hung air conditioner comprising a heat-exchanger unit integrally provided with a heat exchanger, a refrigerant pipe, a drain pan, and a cross-flow fan and is assembled and fixed to the frame, a grill that covers the heat-exchanger unit and is disposed on the front face of a frame, and an installation plate by which the heat-exchanger unit and the grill are supported and which is fixed to a wall in a room, an opening and a cover covering the same are disposed on a lower face of the grill, and a grill stopper portion that fixes the grill to the frame and a frame stopper portion that fixes the frame to the installation plate are integrally disposed in the opening which is exposed when the cover is opened.

According to this configuration, the grill can be firmly fixed to the frame by the grill stopper portion, and the frame can be fixed to the installation plate by the frame stopper portion in a state in which a gap between the installation plate and the frame is decreased. Moreover, since the grill stopper portion and the frame stopper portion are integrally disposed in the single opening, the number of covers that close the opening can be decreased as compared with the case in which openings are formed respectively for the grill stopper portion and the frame stopper portion, and increase in the number of components can be prevented. Moreover, since the grill stopper portion and the frame stopper portion are integrally disposed in the single opening, the number of openings is smaller as compared with the case in which openings are formed respectively for the grill stopper portion and the frame stopper portion, and deterioration in designability involved in the formation of the openings can be suppressed.

Here, in the wall-hung air conditioner of the present invention, the openings may be formed in plural with an interval in the longitudinal direction on the lower face of the grill, and the grill stopper portion and the frame stopper portion may be integrally disposed at each of the plurality of openings.

According to this configuration, while the increase in the number of components and deterioration in the designability are suppressed, the frame can be fixed to the installation plate in the state in which the gap between the installation plate and the frame is further decreased, and the grill can be fixed to the frame more firmly.

Also, in the wall-hung air conditioner of the present invention, the grill stopper portion may be a portion that fixes the grill to the frame by a screw for grill fixation, and the frame stopper portion may be a portion that fixes the frame to the installation plate by a screw for frame fixation.

According to this configuration, the fixation of the grill to the frame and the fixation of the frame to the installation plate are made possible easily and reliably using the screw for grill fixation and the screw for frame fixation.

Also, in the wall-hung air conditioner of the present invention, a top portion of the screw for grill fixation and a top portion of the screw for frame fixation may be directed to a direction inclined forward to vertically below.

According to this configuration, since the top portion of the screw for grill fixation and the top portion of the screw for frame fixation may be directed to the direction inclined forward to vertically below, a tip end of a driver or the like can be easily brought into contact with the top portion of the screw, by which workability is improved.

Also, in the wall-hung air conditioner of the present invention, the top portion of the screw for grill fixation and the top portion of the screw for frame fixation may be directed to substantially the same direction.

According to this configuration, both the screw for grill fixation and the screw for frame fixation can be worked easily and continuously, by which workability is improved.

Also, in the wall-hung air conditioner of the present invention, the screw for grill fixation and the screw for frame fixation may be disposed with an interval in the longitudinal direction of the grill.

According to this configuration, since the screw for grill fixation and the screw for frame fixation are disposed with an interval in the longitudinal direction of the grill, the screws can be worked more easily as compared with the case in which the screws are disposed close to each other, by which workability is improved.

According to the present invention, while the increase in the number of components and deterioration in the designability are suppressed, the frame can be fixed to the installation plate in the state in which the gap between the installation plate and the frame is decreased, and the grill can be fixed to the frame firmly.

Also, the present invention was made in view of the above circumstances and has an object to provide a wall-hung air conditioner in which wiring connections can be made easily even if a component is added, replaced or the like after installation of an indoor unit.

In order to achieve the above object, the present invention provides, in a wall-hung air conditioner comprising a heat exchanger, a drain pan, and a blower that are assembled and fixed to a frame and a grill that covers the heat exchanger and is disposed on the front face of the frame, a wall-hung air conditioner in which a vertically long electric equipment box is arranged on a side of the heat exchanger, the electric equipment box is provided with a first terminal block and a second terminal block with an interval in the vertical direction, a wiring partition plate is disposed in the middle position of these terminal blocks, the grill is provided with an opening that exposes the first terminal block, the wiring partition plate, and the second terminal block, a wire connected to the first terminal block is connected to a substrate in the electric equipment box through a lower part of the wiring partition plate, and a wire connected to the second terminal block is connected to the substrate in the electric equipment box through an upper part of the wiring partition plate.

According to the above configuration, since the first terminal block and the second terminal block are disposed in the electric equipment box, the first terminal block is made a terminal block for a main substrate for operation control of the indoor unit and the second terminal block is made a terminal block for adding a component corresponding to an optional specification, for example, so that when a component corresponding to an optional specification is to be added later, wiring connection can be made easily using this second terminal block.

Also, according to the above configuration, if a wire connected to the first terminal block is to be connected to a control substrate for operation control of the indoor unit, for example, the wire connected to the first terminal block is connected to the substrate in the electric equipment box through the lower part of the wiring partition plate. Therefore, by covering the wire connected to the first terminal block by the wiring partition plate, inadvertent contact by a maintenance worker or the like can be prevented.

Also, by the wiring partition plate, interference between the wire connected to the first terminal block and the wire connected to the second terminal block can be prevented.

Also, the present invention is characterized in that, in the above mode, the wire connected to the first terminal block is connected to a first substrate in the electric equipment box, and the wire connected to the second terminal block is connected to a second substrate in the electric equipment box.

According to the above configuration, the wire connected to the first terminal block can be connected to the main substrate for operation control of the indoor unit as the first substrate, for example. Also, the second terminal block can be used as a terminal block if a component corresponding to an optional specification such as a sub substrate or the like is added as a second substrate later.

Also, the present invention is characterized in that, in the above mode, the electric equipment box includes an inner plate arranged on the heat exchanger side and an outer plate opposite to the inner plate, the substrate is contained between the inner plate and the outer plate, a front plate projecting to the heat exchanger side is disposed consecutively to the front end of the inner plate, the first terminal block, the second terminal block, and the wiring partition plate are arranged on the front plate, and between the inner plate and the outer plate is covered by a detachable front cover member.

According to the above configuration, since the substrate is contained between the inner plate and the outer plate and covered by the detachable cover member, and the first terminal block, the second terminal block, and the wiring partition plate are arranged on the front plate projecting to the heat exchanger side consecutively to the front end of the inner plate, exposure of the contained portion of the substrate from the opening in the grill can be prevented.

Also, the present invention is characterized in that, in the above mode, the outer plate hinge-connects the depth end so that the front end is formed capable of being opened/closed to the side.

According to the above configuration, by opening the outer plate of the electric equipment box to the side, various works such as a connector insertion work on the substrate contained in the electric equipment box involved in component addition corresponding to an optional specification can be performed.

Also, the present invention is characterized in that, in the above mode, on the rear face of the outer plate, the first substrate to which the wire connected to the first terminal block is connected is mounted.

According to the above configuration, since the first substrate is mounted on the rear face of the outer plate, while the outer plate is opened and the first substrate is supported by the outer plate, various works such as the connector insertion work to the first substrate involved in the component addition corresponding to an optional specification can be performed.

Also, the present invention is characterized in that, in the above mode, an opening is disposed on the front face side of the electric equipment box, and the second substrate connected to the second terminal block through the opening is contained in the electric equipment box capable of being withdrawn forward.

According to the above configuration, if the second substrate such as the sub substrate is to be added as a component corresponding to an optional specification, the second substrate can be inserted through the opening disposed on the front face side of the electric equipment box to be contained. Also, replacement of a component of an optional specification or the like can be performed easily by withdrawing the second substrate contained in the electric equipment box through the opening without removing the electric equipment box from the indoor unit.

According to the present invention, since the terminal blocks are disposed in advance, wiring connections can be made easily even in the case of component addition or replacement after installation of the indoor unit.

The present invention has an object to ensure a safe working space between an installation plate and an indoor unit even if a distance from a ceiling to an installation position of the indoor unit is small in the case of installation of the indoor unit of a split air conditioner on a indoor wall face.

In order to achieve the above object, an installing device of an air conditioner of the present invention is characterized in that, in an installing device that mounts an air conditioner to an installation plate fixed to a wall face, an adjustment mechanism that changes a flip-up height of the air conditioner when the air conditioner is to be mounted to the installation plate is disposed on the installation plate and/or the air conditioner.

Also, the present invention is characterized in that, in the above configuration, the adjustment mechanism is an L-shaped supporting member disposed on the rear side of the air conditioner rotatably in the front-and-rear direction, and a plurality of mounting holes that mount the supporting member to the installation plate by changing an angle formed by the supporting member and the installation plate are disposed in the installation plate.

Also, the present invention is characterized in that, in the above configuration, the supporting member has a plane portion on an L-shaped shorter side in the case of increase in the flip-up height of the air conditioner or an L-shaped bent portion in the case of decrease in the flip-up height fitted in the mounting holes, respectively.

Also, the present invention is characterized in that, in the above configuration, the L-shaped supporting member also functions as a fixing member that fixes a refrigerant pipeline arranged on the rear side of the air conditioner.

Also, the present invention is characterized in that, in the above configuration, the installation plate has a function to determine an installation position of the air conditioner on the wall face and a penetrating position of the refrigerant pipeline extending from the air conditioner to the outside through the wall face.

Also, the present invention is characterized in that, in the above configuration, the mounting hole is a slit forming a knock-out hole portion disposed in the installation plate in order to determine the position of the refrigerant pipeline extending to the outside.

Also, the present invention is characterized in that, in the above configuration, the adjustment mechanism is a supporting member disposed on the rear side of the air conditioner and constituted telescopically and has one end fitted in the mounting hole formed in the installation plate, and by adjusting the length of this supporting member, the flip-up height of the air conditioner can be changed.

Also, the present invention is characterized in that, in the above configuration, the supporting member is constituted by a first supporting tool and a second supporting tool that slides and is engaged with the first supporting tool.

According to the invention, by changing the flip-up height of the air conditioner, even if the distance from the ceiling to the installation position of the air conditioner is short, a safe working space can be ensured between the installation plate and the air conditioner.

Also, according to the invention, the L-shaped supporting member can be used as the adjustment mechanism that changes the flip-up height of the air conditioner during a piping work and as a pipeline holder that holds the refrigerant pipeline and the drain pipeline while it is contained in the air conditioner.

Also, according to the invention, the installation plate can determine the installation position of the air conditioner and the position of the pipeline extending from the air conditioner.

Also, according to the invention, since the mounting hole also functions as the slit of the knock-out hole portion disposed in the installation plate in order to determine the position of the refrigerant pipeline extending from the air conditioner to the outside through the wall face, it is no longer necessary to form a new mounting hole.

Also, according to the invention, since the flip-up height of the air conditioner can be adjusted by adjusting the length of the telescopic supporting member according to the distance from the ceiling to the installation position of the air conditioner, a safe working space effectively using the distance from the ceiling to the installation position of the air conditioner can be sufficiently ensured between the installation plate and the air conditioner.

DETAILED DESCRIPTION OF EMBODIMENTS

Embodiments of the present invention will be described below referring to the attached drawings.

First Embodiment

Figure 1:
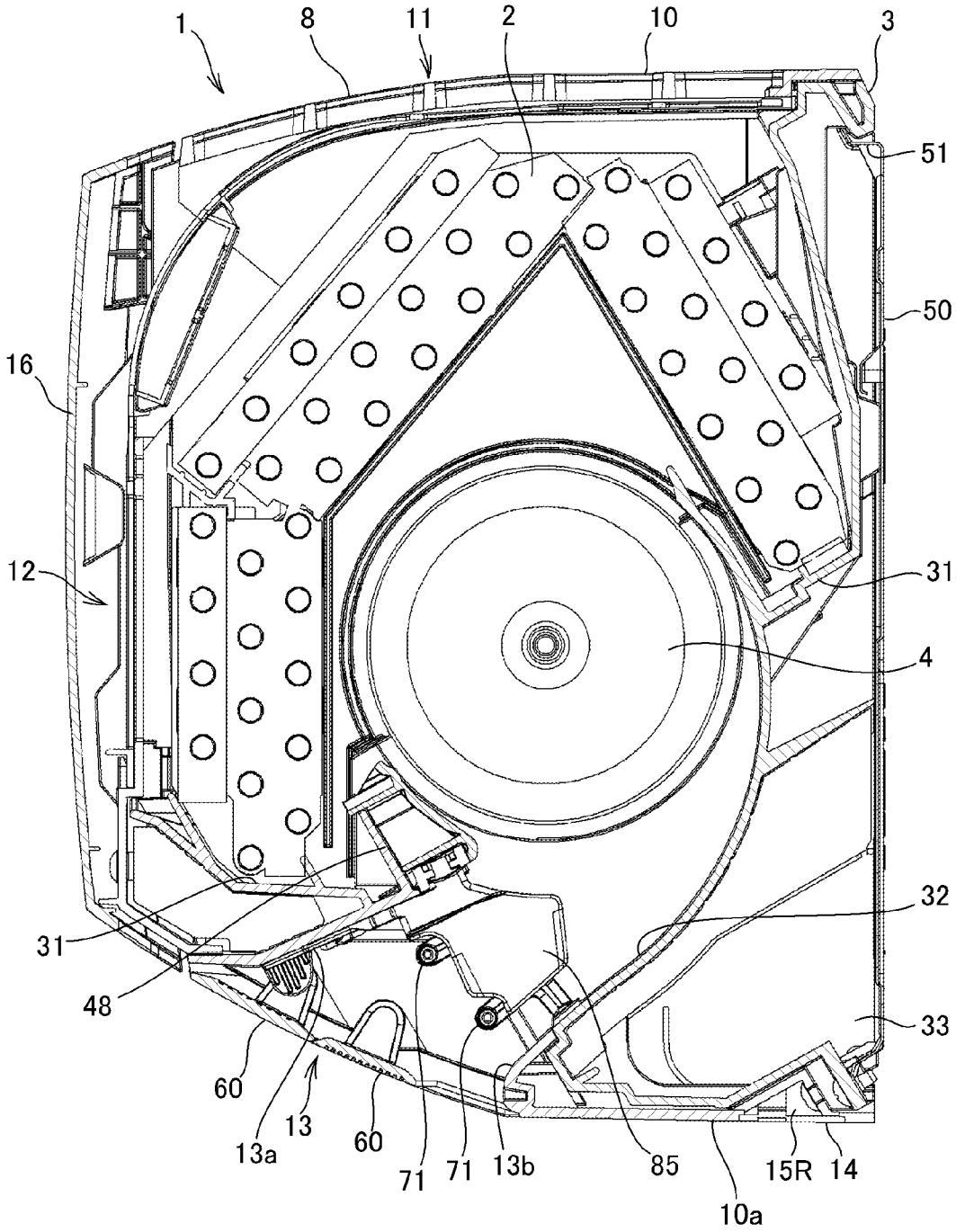
FIG. 1 is a sectional view of a wall-hung air conditioner according to an embodiment of the present invention.
Figure 2:
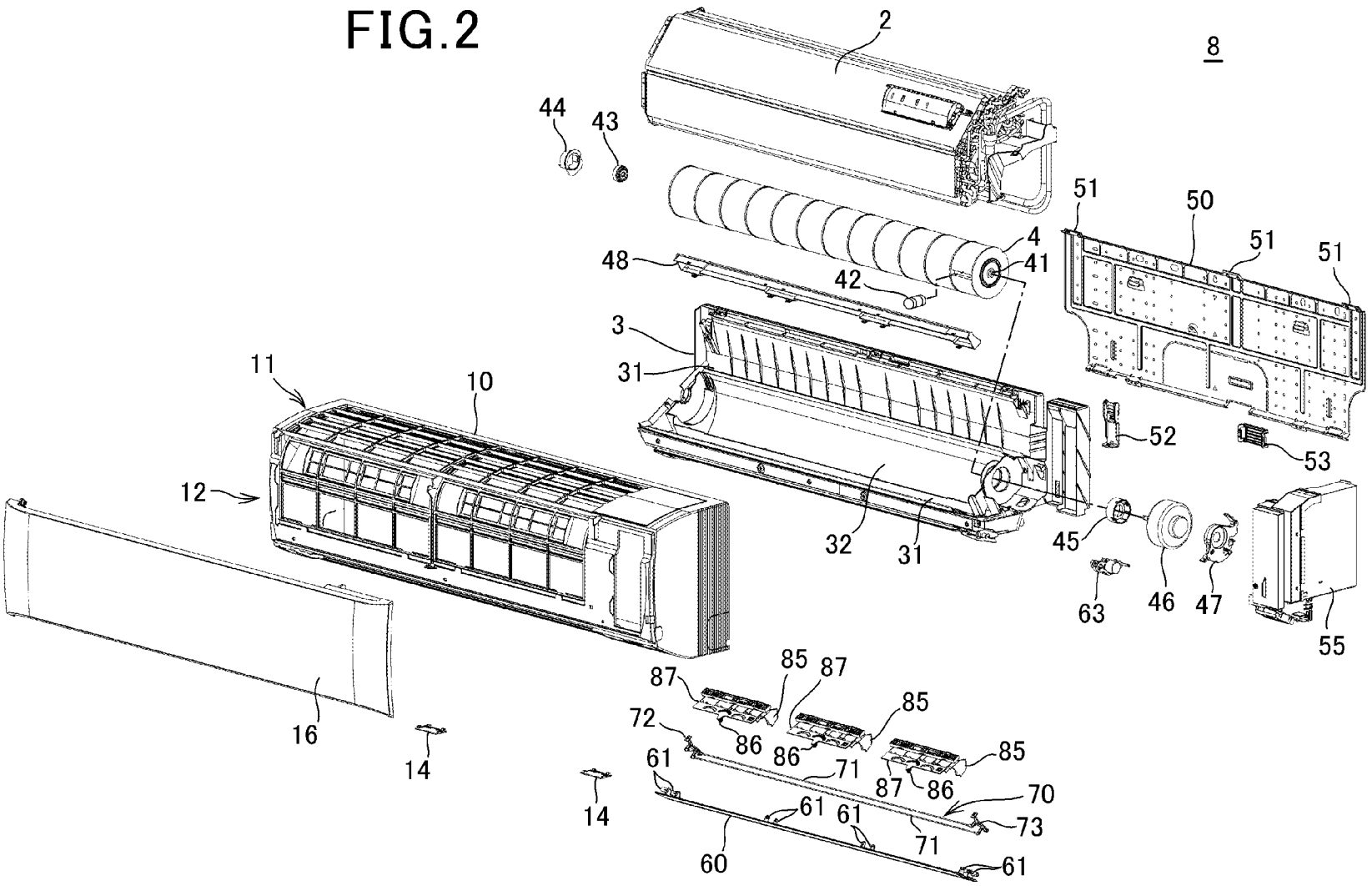
FIG. 2 is an exploded perspective view of the wall-hung air conditioner.

FIG. 1 is a sectional view of a wall-hung air conditioner 1 according to a first embodiment to which the present invention is applied, and FIG. 2 is an exploded perspective view of the wall-hung air conditioner 1.

An indoor unit 8 of the wall-hung air conditioner 1 is constituted by disposing a fin-and-tube type heat exchanger 2 formed with a substantially C-shaped section on a frame 3 and by arranging a blower (cross-flow fan) 4 inside the heat exchanger 2, and the heat exchanger 2 is covered by a grill 10. The frame 3 is a member formed having a substantially L-shaped section by resin molding, is provided with a drain pan 31 that receives drain water flowing down from the heat exchanger 2 and a scroll portion 32 that contains the blower 4 and has a recess portion that receives a locking claw 51 of an installation plate 50 formed on the back face of the frame 3. A housing of the wall-hung air conditioner 1 is constituted by the frame 3 and the grill 10.

The frame 3 and the installation plate 50 as well as the frame 3 and the grill 10 are connected to each other, respectively, by screws, and service holes 15 for the screwing work is opened on the lower face of the grill 10. The service hole 15 is blocked by a screw cap 14 in usual use.

The blower 4 is constituted by a so-called cross-flow fan and contained between a tongue portion 48 and the scroll portion 32 that are disposed on the frame 3, and both ends of the blower 4 are supported by the frame 3 through a bearing portion 44 having a bearing 43 and a bearing portion 45.

A fan motor 46 is connected to one end of the blower 4, and the fan motor 46 is mounted on the frame 3 through a bearing 47. When explained in more detail, a hole 41 through which an output shaft of the fan motor 46 is inserted is disposed at one end of the blower 4, and the output shaft of the fan motor 46 inserted through this hole 41 is fixed to the blower 4 by a set screw 42 screwed from the side face of the blower 4. Also, an electric equipment box 55 is arranged on the side of the fan motor 46.

On a lower part on the rear face side of the frame 3, a pipeline container portion 33, which is a longitudinal space that contains a refrigerant pipeline and a drain pipe, is formed, and pipeline holders 52 and 53 that hold down the pipelines in the pipeline container portion 33 are mounted.

In the grill 10, an upper-face inlet 11 and a front-face inlet 12 are opened, and a front panel 16 is mounted so as to cover the front-face inlet 12.

The blower 4 sucks indoor air from the upper-face inlet 11 and the front-face inlet 12 through the heat exchanger 2 and blows out the air heat-exchanged in the heat exchanger 2 from an outlet 13 opened on the lower face of the wall-hung air conditioner 1 into a room to be air-conditioned through a space between the scroll portion 32 and the tongue portion 48.

Two flaps 60 and 60 as lateral blades for wind-direction change are disposed at the outlet 13. The flap 60 has a flap shaft 61 and is rotated vertically around the flap shaft 61. The two flaps 60 and 60 are driven in conjunction by a flap driving motor 63 so as to open/close the outlet 13 and also set a wind direction from the outlet 13 in the vertical direction.

Also, on the outlet side of the scroll portion 32, a plurality of vertical blades 85 for wind-direction change are arranged side by side. The vertical blades 85 form a set of plural pieces (5 pieces in this first embodiment) and connected by a link member 87 on the rear side of the scroll portion 32. The vertical blade 85 is connected to a vertical-blade driving motor (not shown) and changes its direction to right or left according to an operation of the vertical-blade driving motor or an operation of an operation lever 86.

Then, a fan guard 70 is disposed between the vertical blade 85 and the flap 60. The fan guard 70 is constituted by two wires 71 and 71 extended in parallel with each other along the longitudinal direction of the outlet 13 and supporting bodies 72 and 73 that bundle the ends of the wires 71 and 71. The fan guard 70 prevents the hand from inserting into the depth of the outlet 13 by the wires 71 and 71.

Figure 3:
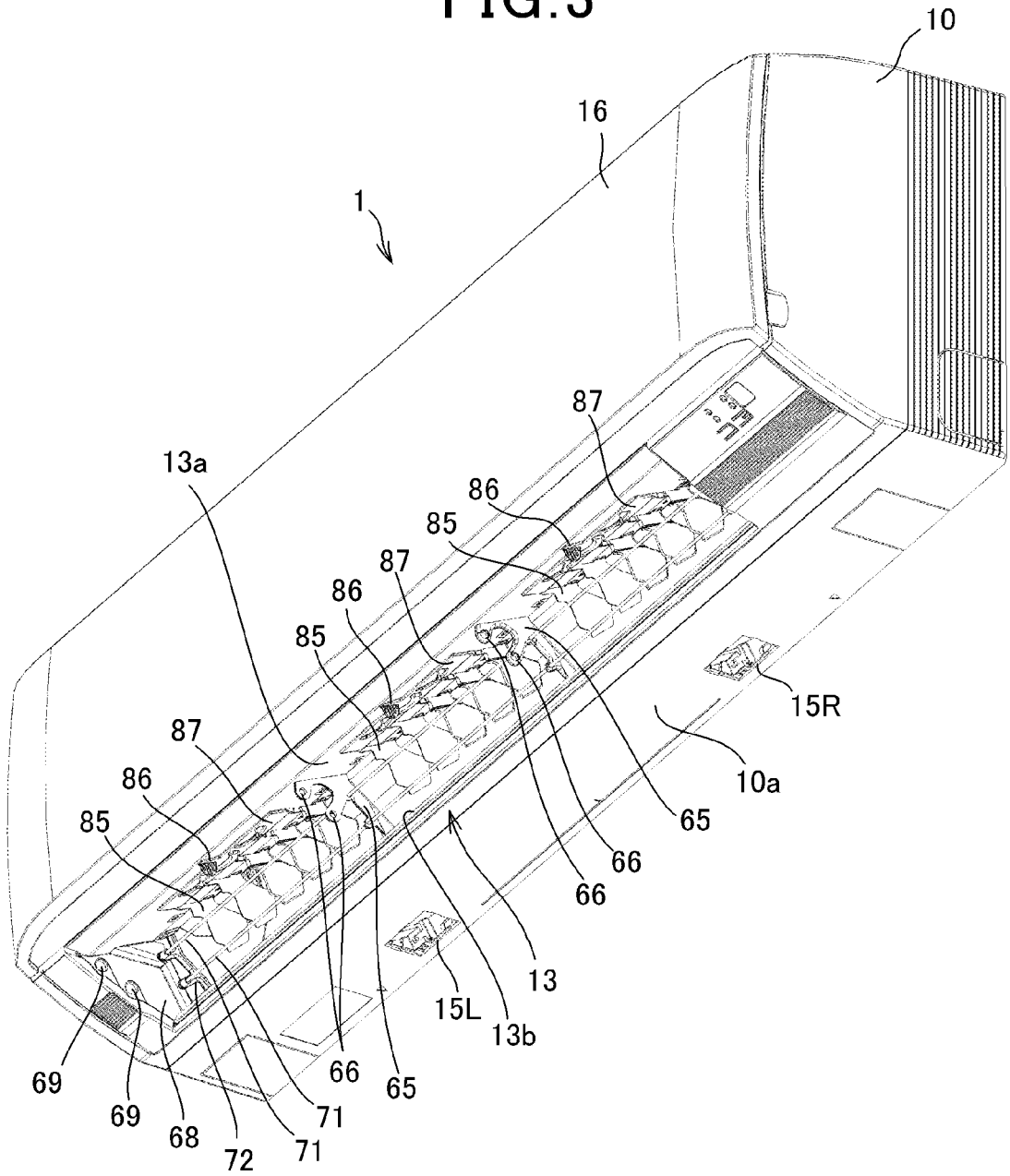
FIG. 3 is an appearance perspective view of the wall-hung air conditioner.

FIG. 3 is a perspective view of the wall-hung air conditioner 1 seen from below. In FIG. 3, the flap 60 is not shown for convenience of understanding.

The supporting body 72 of the fan guard 70 is mounted on one end side of the longitudinal-shaped outlet 13 and the supporting body 73 is mounted on the other end side of the outlet 13.

Also, in the outlet 13, two supports 65 that support the flaps 60 are disposed so that the outlet 13 is equally divided into three parts in the longitudinal direction. The support 65 is extended between an upper edge portion 13*a* and a lower edge portion 13*b* of the outlet 13 and has two supporting holes 66 and 66 into which the flap shafts 61 and 61 of the two flaps 60 and 60 are inserted. At both ends of the outlet 13, flap supporting portions 68 for mounting the flaps 60 are disposed, respectively, and supporting holes 69 and 69 into which the flap shafts 61 and 61 of the two flaps 60 and 60 are inserted are formed in the two flap supporting portions 68, respectively. That is, the flaps 60 are rotatably supported by the two supports 65 and the two flap supporting portions 68. Then, the fan guard 70 is mounted so that the wire 71 is located deeper than the supporting holes 66 and 69 to which the flaps 60 are mounted and in front of the vertical blades 85.

As shown in FIGS. 1 and 3, on a lower face 10*a* of the grill 10, two service holes 15L and 15R (hereinafter referred to as the "service hole 15" if the service holes 15L and 15R are not particularly distinguished) are opened. The service hole 15 is an opening to make an access to a frame stopper portion 91 to which a screw 90 for frame fixation for fixing the installation plate 50 and the frame 3 is mounted and a grill stopper portion 93 to which a screw 92 for grill fixation for fixing the frame 3 and the grill 10 is mounted. That is, in this first embodiment, the frame stopper portion 91 and the grill stopper portion 93 are integrally disposed in the single service hole 15.

As shown in FIG. 3, each of the service hole 15L and the service hole 15R is formed with a predetermined interval in the longitudinal direction in the lower face 10*a* of the grill 10. The service holes 15L and 15R are blocked by the screw cap 14 (cover) in usual use.

Figure 4:
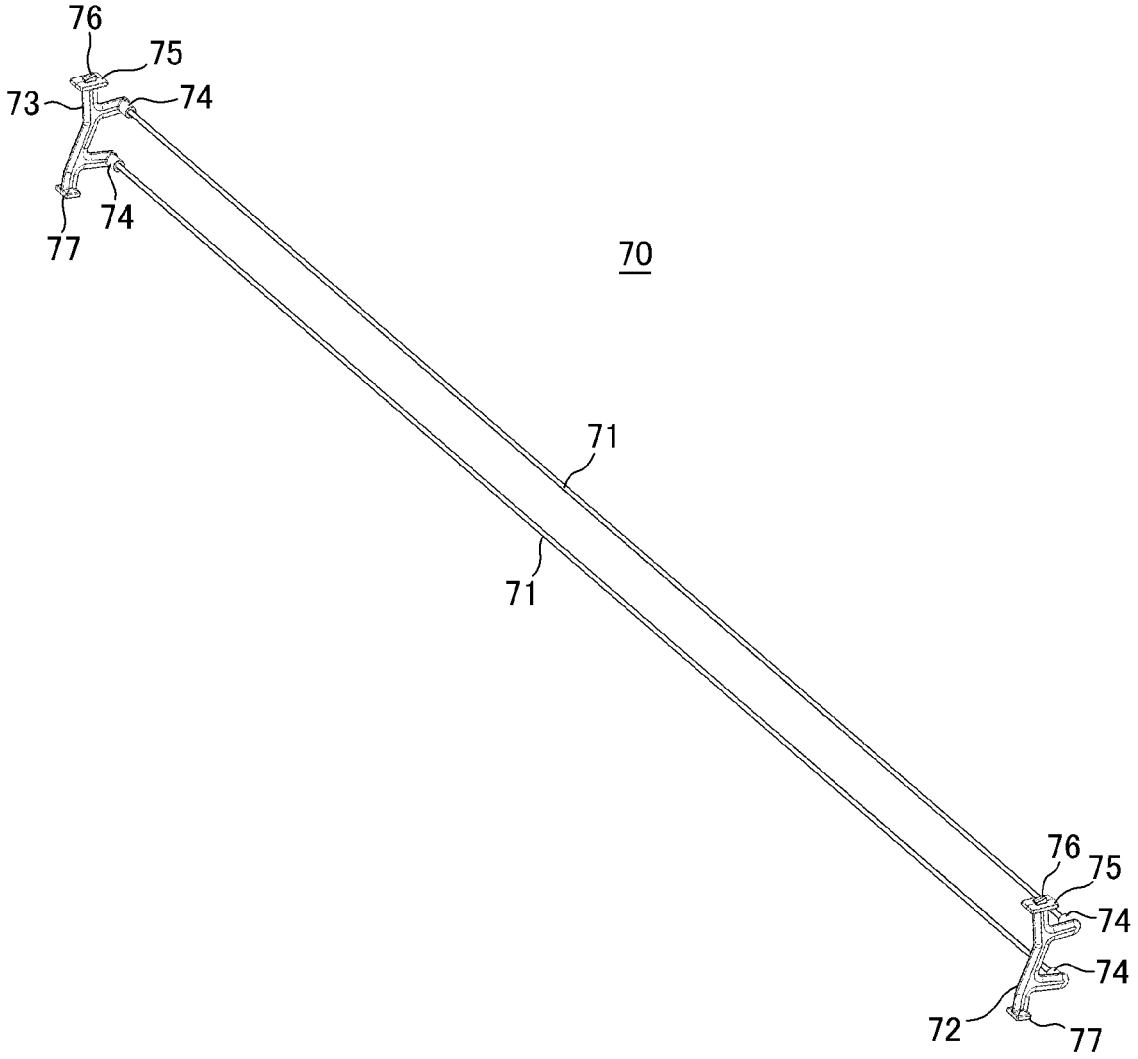
FIG. 4 is a perspective view illustrating a configuration of a fan guard.

FIG. 4 is a perspective view illustrating a configuration of the fan guard 70.

The supporting bodies 72 and 73 located at the both ends of the fan guard 70 have two end-portion receivers 74 into which end portions of the two wires 71 are inserted, respectively, at a columnar main body. At an upper end of the columnar main body, an upper contact plate 75 is formed, a projection 76 is stood on the upper face of the plate shaped upper contact plate 75, and a lower contact plate 77 is formed at the lower end of the main body.

Figure 5:
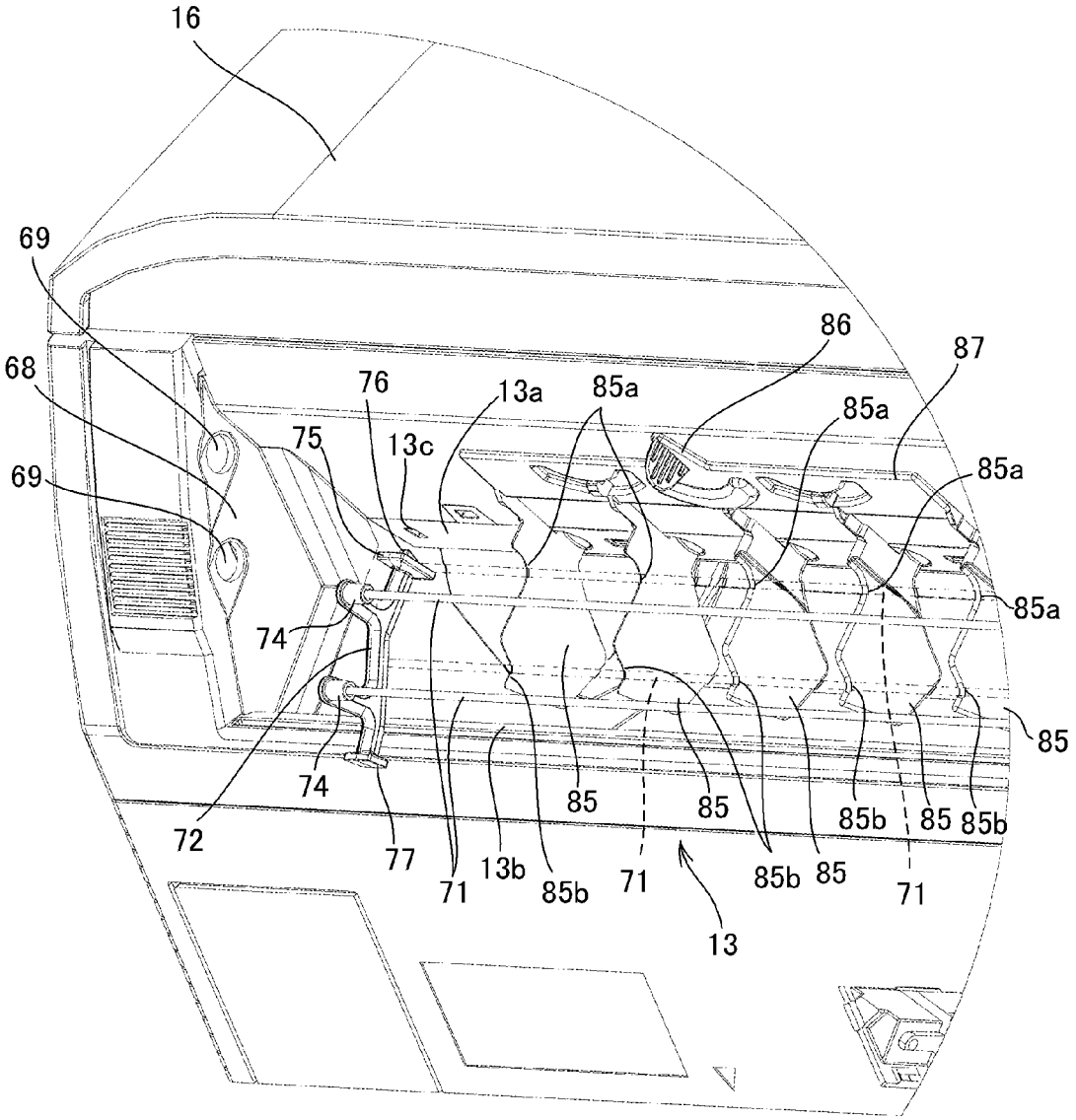
FIG. 5 is a perspective view of an essential part illustrating a mounting method of the fan guard.
Figure 6:
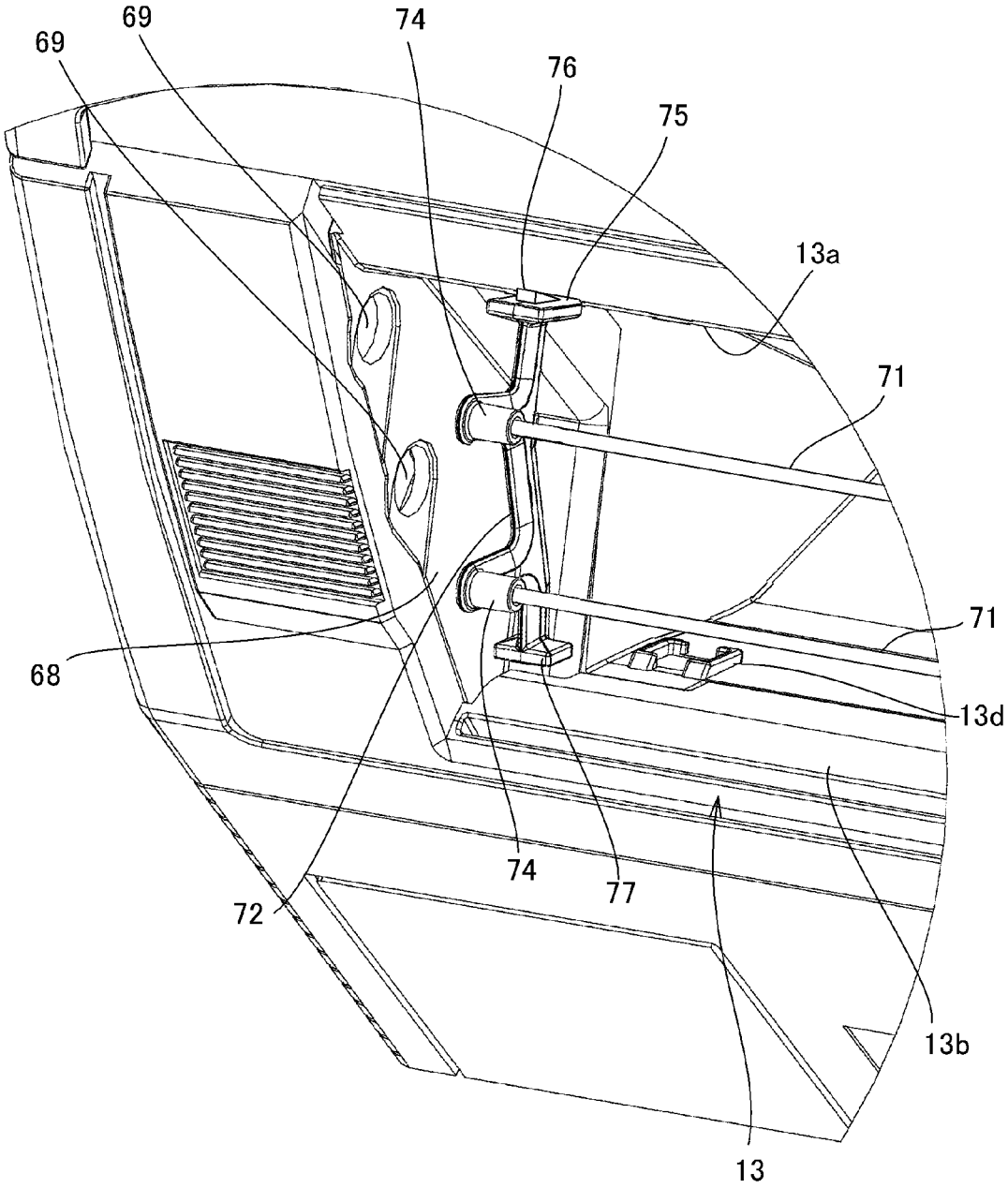
FIG. 6 is a perspective view of the essential part illustrating a mounting method of the fan guard.

FIGS. 5 and 6 are perspective views of an essential part illustrating a mounting method of the fan guard 70 and particularly show a mounting method of the supporting body 72 to the outlet 13. FIGS. 5 and 6 both show the right end portion of the outlet 13. In the state shown in FIGS. 5 and 6, the supporting body 72 is not fixed to the mounting position and the position of the wires 71 and 71 after being installed are shown by a broken line in FIG. 5.

As shown in FIG. 5, a receiving hole 13*c* (hole) that can engage the projection 76 is drilled at the mounting position of the supporting body 72 in the upper edge portion 13*a* of the outlet 13.

On the other hand, as shown in FIG. 6, at the position substantially corresponding to immediately below the receiving hole 13*c*, a supporting frame 13*d* (receiving portion) is disposed in compliance with the outer shape of the lower contact plate 77 on the lower edge portion 13*b*. The supporting frame 13*d* is a frame with which the lower contact plate 77 can be fitted, and the lower contact plate 77 fitted in this supporting frame 13*d* is fixed so as not to move in the horizontal direction.

A mounting procedure of the supporting body 72 will be described referring to FIGS. 5 and 6. Since the supporting body 73 is configured symmetrically with the supporting body 72, the supporting body 73 can be mounted by the procedure similar to the following explanation.

First, the upper contact plate 75 of the supporting body 72 is inserted into the outlet 13, and the projection 76 is fitted in the hole 13*c* (FIG. 5). Then, the lower part of the supporting body 72 is rotated and the lower contact plate 77 is inserted into the outlet 13 and brought into contact with the supporting frame 13*d* (FIG. 6).

Here, by pushing up the upper part of the supporting body 72 or by pushing up the upper edge portion 13*a* together with the supporting body 72 so as to press the upper edge portion 13*a*, the upper edge portion 13*a* is deflected and the supporting body 72 is raised. Here, the lower contact plate 77 is inserted into the supporting frame 13*d*, and the force pressing the upper edge portion 13*a* is released, and then, the upper edge portion 13*a* is recovered, and the supporting body 72 is fixed between the upper edge portion 13*a* and the lower edge portion 13*b*. In the supporting body 72, the projection 76 is inserted into the receiving hole 13*c* in the upper part and the lower contact plate 77 is inserted into the supporting frame 13*d* in the lower part, and in order to remove them, it is necessary to widen the gap between the upper edge portion 13*a* and the lower edge portion 13*b*. Thus, the fan guard 70 can be mounted easily through one-touch operation and moreover, is held so as not to be removed easily.

As shown in FIG. 1, the upper edge portion 13*a* is located below (rear side) of the drain pan 31 and is separated from the structure to ensure strength of the frame 3 (such as the periphery of the tongue portion 48 or a recess portion that receives the locking claw 51 of the installation plate 50, for example). Thus, the upper edge portion 13*a* is elastically deformed by a pressing force relatively easily as compared with the other portions of the frame 3. Thus, by placing the supporting body 72 onto the upper edge portion 13*a* and pressing the upper edge portion 13*a* upward, the lower contact plate 77 can be contained in the supporting frame 13*d* by the pressing force larger than the predetermined.

Also, as shown in FIGS. 4 and 5, since the projection 76 has a shape in which the front side is higher than the rear side, in order to remove the projection 76 from the receiving hole 13*c*, it is necessary to press the upper edge portion 13*a* so as to deform the upper edge portion 13*a* more largely than during the mounting. Thus, when the supporting body 72 is to be removed, a larger force becomes required. That is, a structure that can be mounted easily and cannot be removed easily can be obtained. The same applies to the supporting body 73.

On the other hand, if it is necessary to insert a tool or the like through the outlet 13 for maintenance of the blower 4 or the like, by strongly pushing up the upper edge portion 13*a*, the supporting bodies 72 and 73 can be removed. As mentioned above, the fan guard 70 has a useful configuration that does not interfere with maintenance or the like, can be mounted easily, and cannot be removed easily.

The fan guard 70 mounted as above is supported together with the supporting bodies 72 and 73 by the supports 65 and the vertical blades 85.

As shown in FIGS. 1 and 5, on the front edge of the vertical blade 85, two receiving portions 85*a* and 85*b* cut away in the rear are formed. The receiving portion 85*a* is formed in the rearward recess shape drawing a curve of the size that can contain the wire 71 and is extended to the front above and below the wire 71. Also, the receiving portion 85*b* similarly draws a recess curve of the size that can contain the wire 71 and is extended to the front above the wire 71. Thus, as shown in FIG. 1, in a state in which the wire 71 is contained in the receiving portion 85*a*, if the wire 71 is vertically moved, it is brought into contact with the extended part of the receiving portion 85*a*. In the receiving portion 85*b*, too, if the wire 71 is moved upward, it is brought into contact with the extended part of the receiving portion 85*b*. Therefore, by the vertical blade 85, the wire 71 is restricted so as not to be moved vertically. Moreover, as shown in FIG. 1, the wires 71 and 71 contained in the receiving portions 85*a* and 85*b* are both brought into contact with the vertical blade 85 if being pushed into the rear side. Therefore, by the vertical blade 85, the wire 71 is regulated so as not to be pushed into the rear side.

Figure 7:
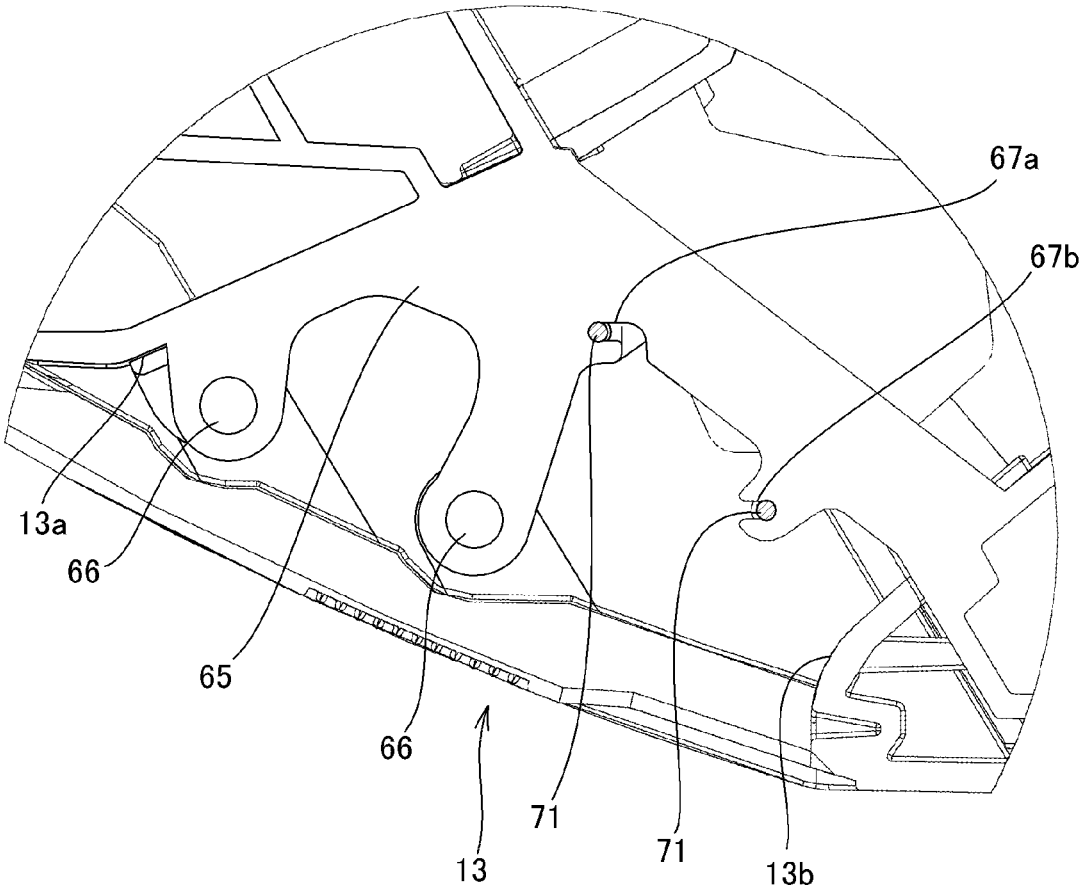
FIG. 7 is an enlarged sectional view of an essential part illustrating a supporting structure of wires.

FIG. 7 is an enlarged sectional view of an essential part illustrating a supporting structure of the wire 71 and particularly shows the side face of the support 65 disposed at the outlet 13.

As shown in FIG. 7, in the front edge of the support 65, receiving grooves 67*a* and 67*b* that can be engaged with the two wires 71 and 71 are formed. The receiving grooves 67*a* and 67*b* are exposed to the front side of the outlet 13 in the support 65 so that the wires 71 and 71 can be inserted therein from the front side of the outlet 13. Therefore, when the supporting bodies 72 and 73 are mounted on the outlet 13 according to the above-described procedure, the wires 71 and 71 can be easily set in the receiving grooves 67*a* and 67*b*.

The receiving grooves 67*a* and 67*b* are located deeper than the supporting holes 66 and grasp the wires 71 in the rear of the flap 60. In the receiving groove 67*a* located on the upper side, the wire 71 can be inserted from the lower side and pushed into the front side so as to be fitted therein. Also, in the lower receiving groove 67*b*, the wire 71 can be pushed in from the front to be fitted therein. The wires 71 and 71 fitted in the receiving grooves 67*a* and 67*b* are not removed unless a force larger than the predetermined is applied in the direction opposite to the above. With this configuration, the wires 71 and 71 are held by the supports 65 so as not to be moved easily to the front and rear or to the up and down.

As mentioned above, the wires 71 and 71 are held by the supporting bodies 72 and 73 and the supports 65 so as not to be moved to the front and rear or to the up and down and also movement to the rear and to up and down is regulated by the vertical blades 85. Thus, the interval between the plurality of wires 71 and 71 cannot be widened by pushing the wire 71 into the depth of the outlet 13 or by moving the wire 71, and similarly, either of the gap between the wire 71 and the upper edge portion 13*a* of the outlet 13 or the gap between the wire 71 and the lower edge portion 13*b* cannot be enlarged. Therefore, the configuration of the first embodiment sufficiently satisfies the function as the fan guard 70 that prevents insertion of the hand into the outlet 13.

As described above, the wall-hung air conditioner 1 according to the first embodiment to which the present invention is applied is, in the wall-hung air conditioner 1 provided with the vertical blade 85 for wind-direction change, the flap 60, and the fan guard 70 at the outlet 13 of the housing that contains the heat exchanger 2 and the blower 4, since the fan guard 70 is provided with the wires 71 and 71 extending in the longitudinal direction of the outlet 13 and the pair of supporting bodies 72 and 73 that bundles the both ends of these wires 71 and 71, and the fan guard 70 makes the plurality of wires 71 and 71 extend into the space between the vertical blade 85 and the flap 60 so as to fix and mount the pair of supporting bodies 72 and 73 in the outlet 13 through one-touch operation, the fan guard 70 can be easily mounted to the outlet 13 through one-touch operation. Also, by making the wires 71 and 71 extend into the space between the vertical blade 85 and the flap 60, it becomes difficult to remove the wires 71 and 71 by an external force or to move the wires 71 and 71 to the depth or to the front of the outlet 13, and the wires 71 and 71 can be supported against the external force and the state in which the hand cannot be inserted into the outlet 13 can be maintained.

That is, when the supporting bodies 72 and 73 are to be mounted to the outlet 13, it is only necessary to perform a series of operations through one-touch operation that the upper parts of the supporting bodies 72 and 73 are brought into contact with the upper edge portion 13*a* and the upper edge portion 13*a* is pushed up together with the supporting bodies 72 and 73, the lower part of the supporting bodies 72 and 73 are rotated, and the lower contact plate 77 is inserted in the supporting frame 13*d*.

Also, since the support 65 is extended between the upper edge portion 13*a* and the lower edge portion 13*b* of the outlet 13 and the wires 71 and 71 are locked in the receiving grooves 67*a* and 67*b* disposed in this support 65, the wires 71 and 71 are fixed so as not to move vertically or to the side. Thus, the interval between the wires 71 and 71 cannot be widened, and the gap between the wires 71 and 71 and the upper end portion 13*a* or the lower end portion 13*b* cannot be widened, either, and the state in which the hand cannot be inserted into the outlet 13 can be reliably maintained.

Moreover, since the receiving grooves 67*a* and 67*b* of the support 65 are exposed on the front face side of the outlet 13, the wires 71 and 71 can be locked in the receiving grooves 67*a* and 67*b* of the support 65 from the front face side, and the fan guard 70 can be mounted more easily.

Furthermore, since the supporting bodies 72 and 73 are mounted between the upper edge portion 13*a* and the lower edge portion 13*b* of the outlet 13 by elastically deforming the upper edge portion 13*a*, they can be easily attached to the outlet 13 through one-touch operation, and the supporting bodies 72 and 73 can be fixed more reliably by the elastic force of the upper edge portion 13*a* after the attachment.

Also, since the projection 76 is formed at the upper end of the supporting bodies 72 and 73, the lower contact plate 77 is formed at the lower end, the receiving hole 13*c* engaged with the projection 76 is formed in the upper edge portion 13*a* of the outlet 13, and the supporting frame 13*d* that supports the lower contact plate 77 is formed on the lower edge portion 13*b*, the supporting bodies 72 and 73 can be more easily attached by elastically deforming the upper edge portion 13*a* through one-touch operation while holding one of the supporting bodies 72 and 73 with one hand, for example. Also, after the attachment, since the projection 76 is inserted into the receiving hole 13*c* by the elasticity of the upper edge portion 13*a* and is held so that the lower contact plate 77 does not easily drop from the supporting frame 13*d*, the fan guard 70 can be reliably fixed.

Moreover, since the receiving portions 85*a* and 85*b* that regulate movement of the wires 71 and 71 in either of upward or downward or in the both directions are disposed in the vertical blade 85, it becomes impossible to widen the interval between the wires 71 and 71 by vertically moving the wires 71 and 71 or to widen the gap between the wires 71 and 71 and the upper edge portion 13*a* or the lower edge portion 13*b*, the state in which the hand cannot be inserted into the outlet 13 can be maintained more reliably.

The above-described first embodiment shows only a mode to which the present invention is applied and the present invention is not limited to that. For example, the receiving grooves 67*a* and 67*b* disposed in the support 65 are explained as the grooves having a width through which the wire 71 can pass, but the present invention is not limited to that, and it may be so configured that the groove has a portion narrower than the diameter of the wire 71 and the wire 71 is grasped so as not to drop by the elasticity of the support 65 by pushing the wire 71 into this portion. It may also be configured that the wires 71 and 71 are arranged at positions deeper in the receiving portions 85*a* and 85*b* formed in the vertical blade 85 and the movement of the wires 71 and 71 in the both up and down directions is regulated by the receiving portions 85*a* and 85*b*.

In the above-described first embodiment, the configuration in which the fan guard 70 is disposed at the outlet 13 that opens in the lower face of the wall-hung air conditioner 1 is explained as an example, but the present invention is not limited to that, and the fan guard 70 may be disposed at the outlet that opens in the front face of the air conditioner, for example. Moreover, the supporting bodies 72 and 73 constituting the fan guard 70 do not have to be symmetrical, and it is only necessary that the mounting positions of the supporting bodies 72 and 73 are substantially at the end portions of the outlet 13 and does not have to be at the end of the outlet 13 as shown in FIGS. 3, 5, and 6. Also, the numbers of the wires 71, the flaps 60, and the vertical blades 85 are also arbitrary, and a specific detailed configuration of the wall-hung air conditioner 1 can be changed arbitrarily.

Also, in the above-described first embodiment, the example in which the present invention is applied to the wall-hung air conditioner 1 is explained, but the present invention is not limited to that and can be applied to a ceiling-embedded air conditioner or a ceiling-suspended air conditioner.

Second Embodiment

Figure 8:
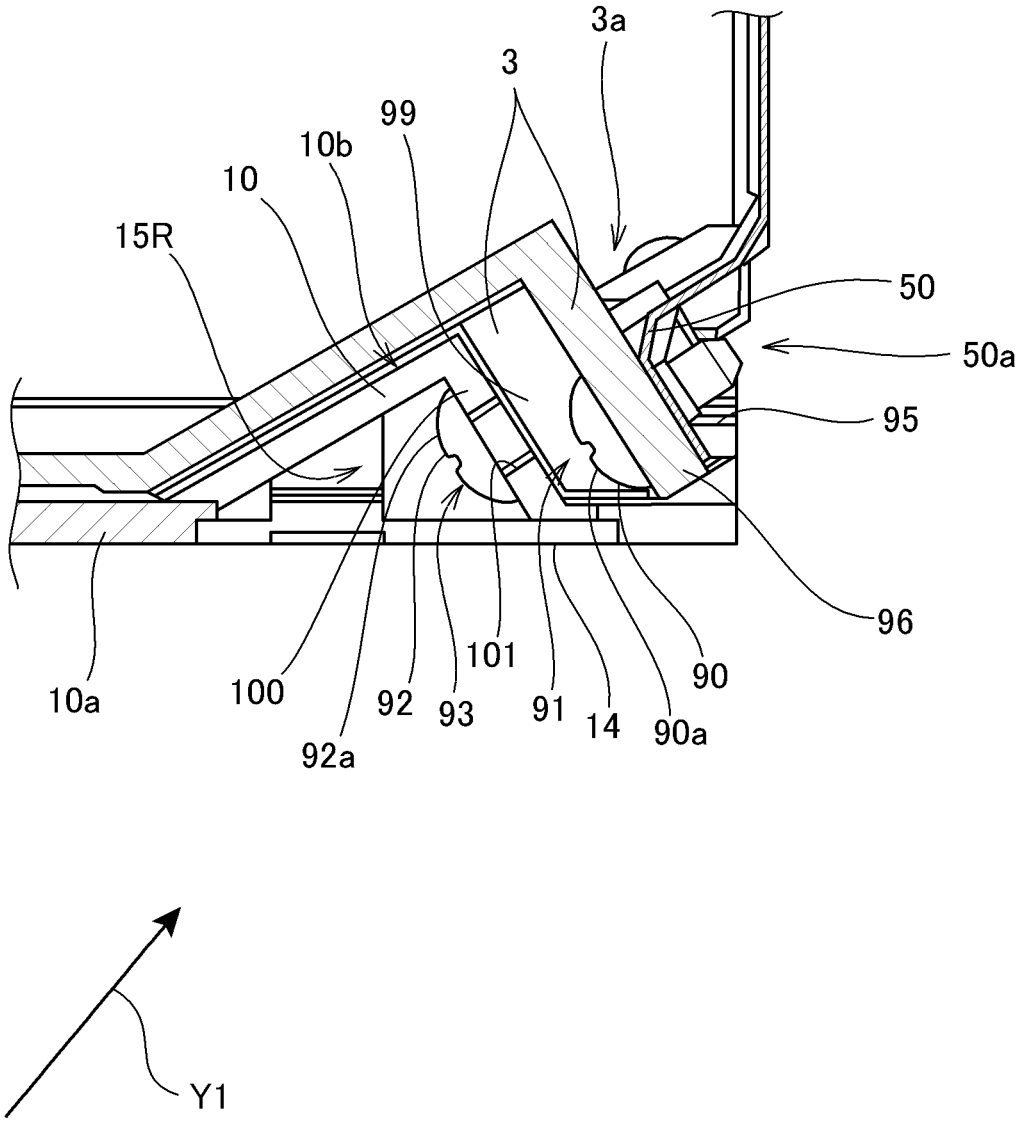
FIG. 8 is a sectional view of an essential part illustrating a frame stopper portion and a grill stopper portion of a second embodiment.
Figure 9:
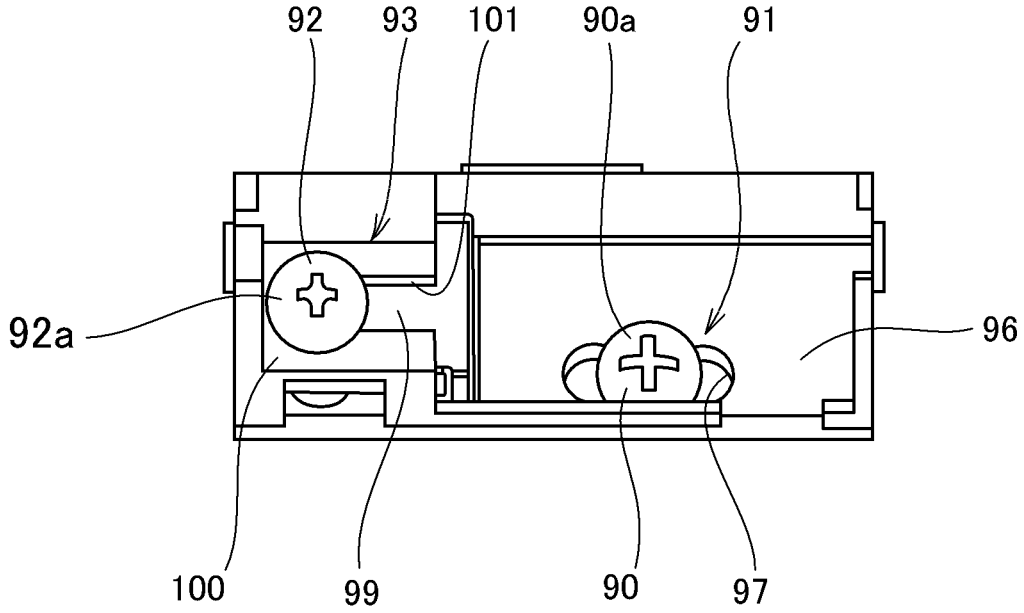
FIG. 9 is a front view of the frame stopper portion and the grill stopper portion of the second embodiment.

FIG. 8 is an enlarged diagram of a portion in the vicinity of the service hole 15R in the wall-hung air conditioner 1 according to a second embodiment of the present invention. FIG. 8 shows the essential part of the sectional view in FIG. 1 in an enlarged manner. FIG. 9 is a diagram showing the frame stopper portion 91 and the grill stopper portion 93 seen from an arrow Y1 direction in FIG. 8.

In this second embodiment, the same reference numerals are given to the same configurations as those in the first embodiment, and the description will be omitted.

In the second embodiment, the configuration in the vicinity of the service hole 15 of the wall-hung air conditioner 1 shown in FIGS. 1 to 3 will be described.

The frame stopper portion 91 is a portion that fixes the frame 3 to the installation plate 50 by the screw 90 for frame fixation. As shown in FIG. 8, the installation plate 50 is folded into the C-shape section at a lower end portion 50*a* thereof, and an installation-plate side contact portion 95 is formed in the portion formed by folding. The installation-plate side contact portion 95 has its front face (the face on the side on contact with a frame-side contact portion 96, which will be described later) directed diagonally lower forward. On the other hand, a lower end portion 3*a* on the installation plate 50 side of the frame 3 is also folded into the C-shaped section, and the frame-side contact portion 96 extending in the state in contact with the installation-plate side contact portion 95 is disposed in the portion formed by folding. In the frame-side contact portion 96, a screw through hole 97 through which a shaft portion of the screw 90 for frame fixation penetrates is formed, and by screwing the screw 90 for frame fixation with the installation-plate side contact portion 95 through the screw through hole 97, the installation-plate side contact portion 95 and the frame-side contact portion 96 are fixed, whereby the frame 3 is fixed to the installation plate 50.

As mentioned above, the installation-plate side contact portion 95 has the front face thereof directed diagonally lower forward. The screw 90 for frame fixation is perpendicularly screwed to the front face of the installation-plate side contact portion 95 directed diagonally lower forward. Therefore, atop portion 90*a* of the screw 90 for frame fixation is directed to the direction inclined forward to vertically below. Thus, when a worker works on the screw 90 for frame fixation by a driver, the tip end of the driver can be brought into contact with the top portion 90*a* of the screw 90 for frame fixation more easily than in a case in which the top portion 90*a* of the screw 90 for frame fixation is directed to the room to be air conditioned, and workability is better.

Here, suppose that a user wants to fix the frame 3 to the installation plate 50 while the gap between the installation plate 50 and the frame 3 is minimized. In this case, the worker removes the screw cap 14 so as to expose the frame stopper portion 91 through the service holes 15L and 15R and screws the screw 90 for frame fixation to the installation-plate side contact portion 95 through the screw through hole 97 using a driver or the like. By screwing of the screw 90 for frame fixation, the installation-plate side contact portion 95 and the frame-side contact portion 96 are fixed in a contact state, whereby the gap formed between the installation plate 50 and the frame 3 is reduced.

The grill stopper portion 93 is a portion that fixes the grill 10 to the frame 3 by the screw 92 for grill fixation. In a portion corresponding to the grill stopper portion 93 in the lower end portion 3*a* of the frame 3, a screw portion 99 into which the screw 92 for grill fixation is screwed is formed. This screw portion 99 is extended in parallel with the above-mentioned frame-side contact portion 96 with a step. Similarly, in a portion corresponding to the grill stopper portion 93 in the lower end portion 10*b* of the grill 10, a grill-side contact portion 100 extending in the state in contact with the screw portion 99 is formed. In the grill-side contact portion 100, a screw notch portion 101 formed by cutting away through which a shaft portion of the screw 92 for grill fixation penetrates is formed. By screwing the screw 92 for grill fixation in the screw portion 99 through the screw notch portion 101, the screw portion 99 and the grill-side contact portion 100 are fixed in the contact state, whereby the grill 10 is fixed to the frame 3.

As mentioned above, since the screw portion 99 is extended in parallel with the frame-side contact portion 96, the front face thereof (the face in contact with the grill-side contact portion 100) is directed diagonally lower forward. The screw 92 for grill fixation is screwed perpendicularly to the front face of the screw portion 99 directed diagonally lower forward. Therefore, the top portion 92*a* of the screw 92 for grill fixation is directed to the direction inclined forward to vertically below. Thus, when the worker works on the screw 92 for grill fixation by a driver, the tip end of the driver can be brought into contact with the top portion 92*a* of the screw 92 for grill fixation more easily than in a case in which the top portion 92*a* of the screw 92 for grill fixation is directed to the room to be air conditioned, and workability is better. Moreover, the screw 90 for frame fixation and the screw 92 for grill fixation are extended in parallel, and the top portion 90*a* of the screw 90 for frame fixation and the top portion 92*a* of the screw 92 for grill fixation are directed to the same direction. Thus, the screw 90 for frame fixation and the screw for grill fixation can be continuously worked, and workability is better. Also, the screw 90 for frame fixation and the screw 92 for grill fixation are disposed with an interval in the longitudinal direction of the grill 10. Therefore, these screws can be worked more easily as compared with a case in which these screws are disposed close to each other, and workability is better.

Here, the grill 10 is a member fixed to the frame 3 so as to cover the frame 3. Therefore, though the upper face and the side faces of the grill 10 are supported by the frame 3 and that state is maintained, the lower face 10*a* of the grill 10 tends to deflect due to the gravity. In this embodiment, in the grill stopper portion 93, since the lower face 10*a* of the grill 10 and the frame 3 are fixed to each other by the screw 92 for grill fixation, the grill 10 and the frame 3 are fixed firmly in a state in which deflection of the lower face 10*a* of the grill 10 is prevented. Particularly, in this embodiment, a service hole is not disposed exclusively for the grill stopper portion 93, but the grill stopper portion 93 is disposed integrally with the frame stopper portion 91 inside the existing service hole 15 to make an access to the frame stopper portion 91. Therefore, as compared with a case in which a service hole for the grill stopper portion 93 is formed separately from the service hole 15, the number of screw caps that block the service holes 15 can be reduced, and the increase in the number of components can be prevented. Moreover, since the grill stopper portion 93 and the frame stopper portion 91 are integrally disposed in the one service hole 15, the number of openings becomes smaller than the case in which the service hole is formed respectively for the grill stopper portion 93 and the frame stopper portion 91, and deterioration in designability involved in the formation of the opening can be suppressed.

As mentioned above, the wall-hung air conditioner 1 according to this embodiment is provided with the service hole 15 and the screw cap 14 that covers the hole on the lower face 10*a* of the grill 10, and in the service hole 15, which is exposed when the screw cap 14 is opened, the grill stopper portion 93 that fixes the grill 10 to the frame 3 and the frame stopper portion 91 that fixes the frame 3 to the installation plate 50 are integrally disposed.

According to the above, the grill 10 can be firmly fixed to the frame 3 by the grill stopper portion 93, and the frame 3 can be fixed to the installation plate 50 by the frame stopper portion 91 in a state in which the gap between the installation plate 50 and the frame 3 is reduced. Moreover, since the grill stopper portion 93 and the frame stopper portion 91 are integrally disposed in the single service hole 15, the number of screw caps that block the service holes can be reduced as compared with the case in which the service hole is formed respectively for the grill stopper portion 93 and the frame stopper portion 91, whereby the increase in the number of components can be prevented. Moreover, since the grill stopper portion 93 and the frame stopper portion 91 are integrally disposed in the single service hole 15, the number of service holes becomes smaller as compared with the case in which the service hole is formed for each of the grill stopper portion 93 and the frame stopper portion 91, whereby deterioration in the designability involved in the formation of the service hole can be suppressed.

Also, in the wall-hung air conditioner 1 according to this embodiment, the service holes 15L and 15R are formed in plural (two pieces) with an interval in the longitudinal direction in the lower face 10*a* of the grill 10, and each of the two service holes 15L and 15R is integrally provided with the grill stopper portion 93 and the frame stopper portion 91.

According to the above, while the increase in the number of components and deterioration in the designability are suppressed, the frame 3 can be fixed to the installation plate 50 in the state in which the gap between the installation plate 50 and the frame 3 is more reduced, and the grill 10 can be fixed to the frame 3 more firmly.

Also, in this embodiment, the grill stopper portion 93 is a portion that fixes the grill 10 to the frame 3 by the screw 92 for grill fixation, while the frame stopper portion 91 is a portion that fixes the frame 3 to the installation plate 50 by the screw 90 for frame fixation.

According to the above, using the screw 92 for grill fixation and the screw 90 for frame fixation, fixation of the grill 10 to the frame 3 and the fixation of the frame 3 to the installation plate 50 can be made possible easily and reliably.

Also, in this embodiment, the top portion 92*a* of the screw 92 for grill fixation and the top portion 90*a* of the screw 90 for frame fixation are directed to the direction inclined forward to vertically below.

According to the above, since the top portion 92*a* of the screw 92 for grill fixation and the top portion 90*a* of the screw 90 for frame fixation are directed to the direction inclined forward to vertically below, the tip end of the driver or the like can be easily brought into contact with the top portion of each screw, whereby workability is improved.

Also, in this embodiment, the top portion 92*a* of the screw 92 for grill fixation and the top portion 90*a* of the screw 90 for frame fixation are directed substantially to the same direction.

According to the above, both the screw 92 for grill fixation and the screw 90 for frame fixation can be continuously worked easily, whereby workability is improved.

Also, in this embodiment, the screw 92 for grill fixation and the screw 90 for frame fixation are disposed with an interval in the longitudinal direction of the grill 10.

According to the above, since the screw 92 for grill fixation and the screw 90 for frame fixation are disposed with an interval in the longitudinal direction of the grill 10, these screws can be worked more easily as compared with the case in which these screws are disposed close to each other, whereby workability is improved.

The above-described second embodiment shows one mode to which the present invention is applied, and the present invention is not limited to that. For example, the service holes 15L and 15R are disposed in two pieces in this embodiment, but the number of the service holes 15 is not limited to that.

Third Embodiment

In the wall-hung air conditioner 1 shown in FIGS. 1 and 2, on the side of a heat exchange unit 20, the electric equipment box 55 configured to be vertically long in the height direction when seen on the front is arranged. On the frame 3, an electric-equipment box assembling portion 34 is disposed on the side of the drain pan 31, and in this electric-equipment box assembling portion 34, the electric equipment box 55 is assembled to the frame 3.

Figure 10:
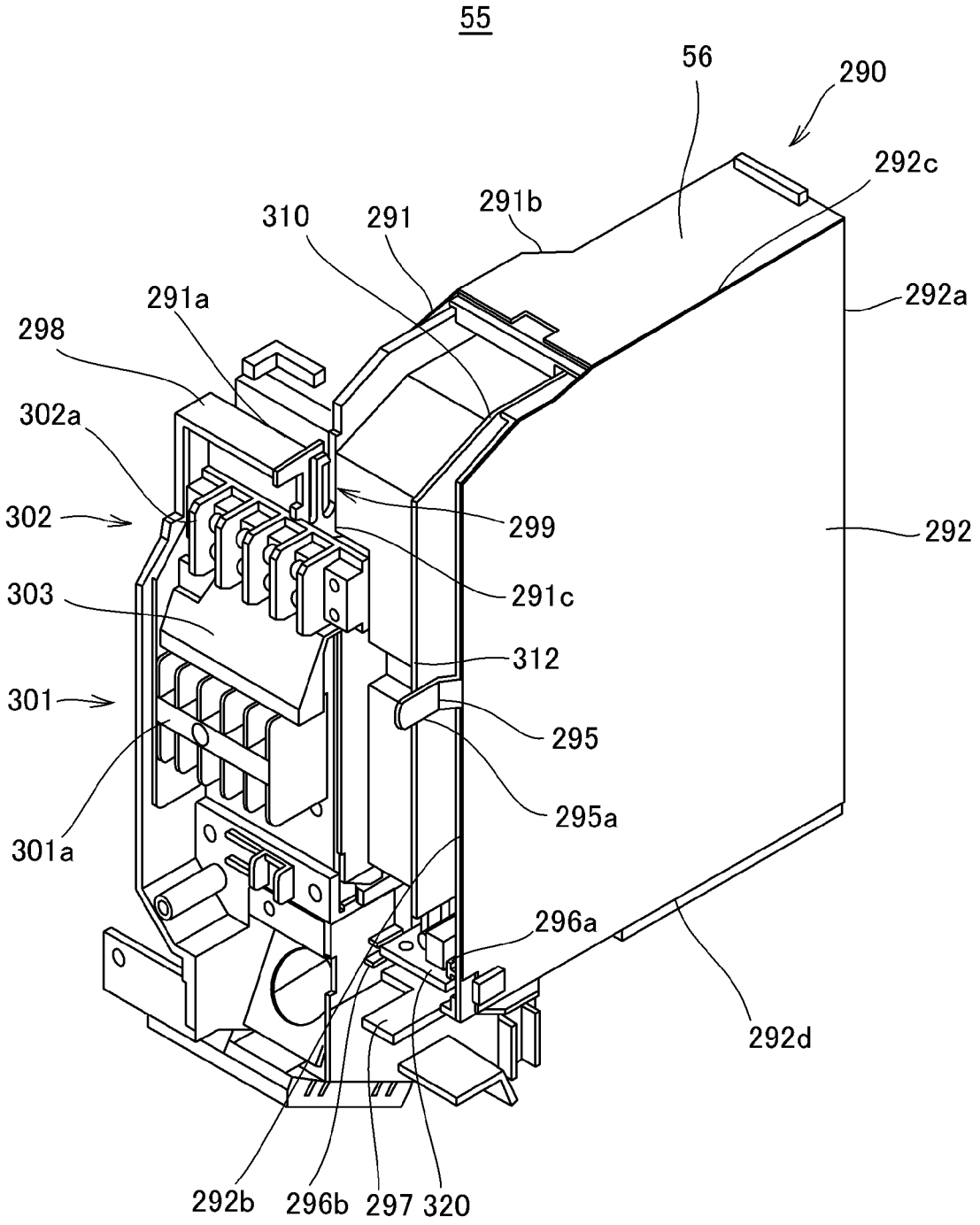
FIG. 10 is a perspective view of an electric equipment box of a third embodiment illustrated from an outer plate side.
Figure 11:
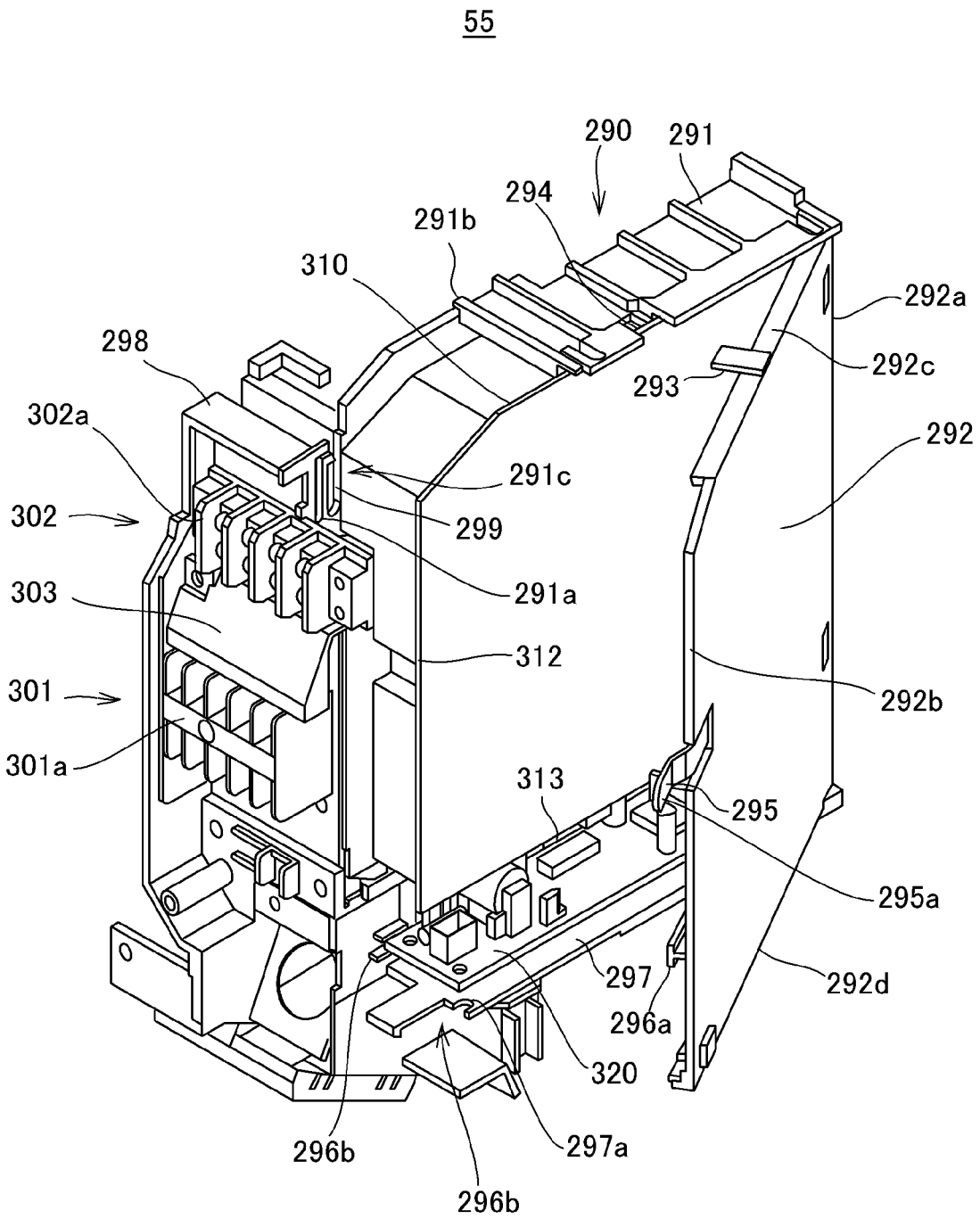
FIG. 11 is a perspective view illustrating a state in which the outer plate of the electric equipment box of the third embodiment is opened.
Figure 12:
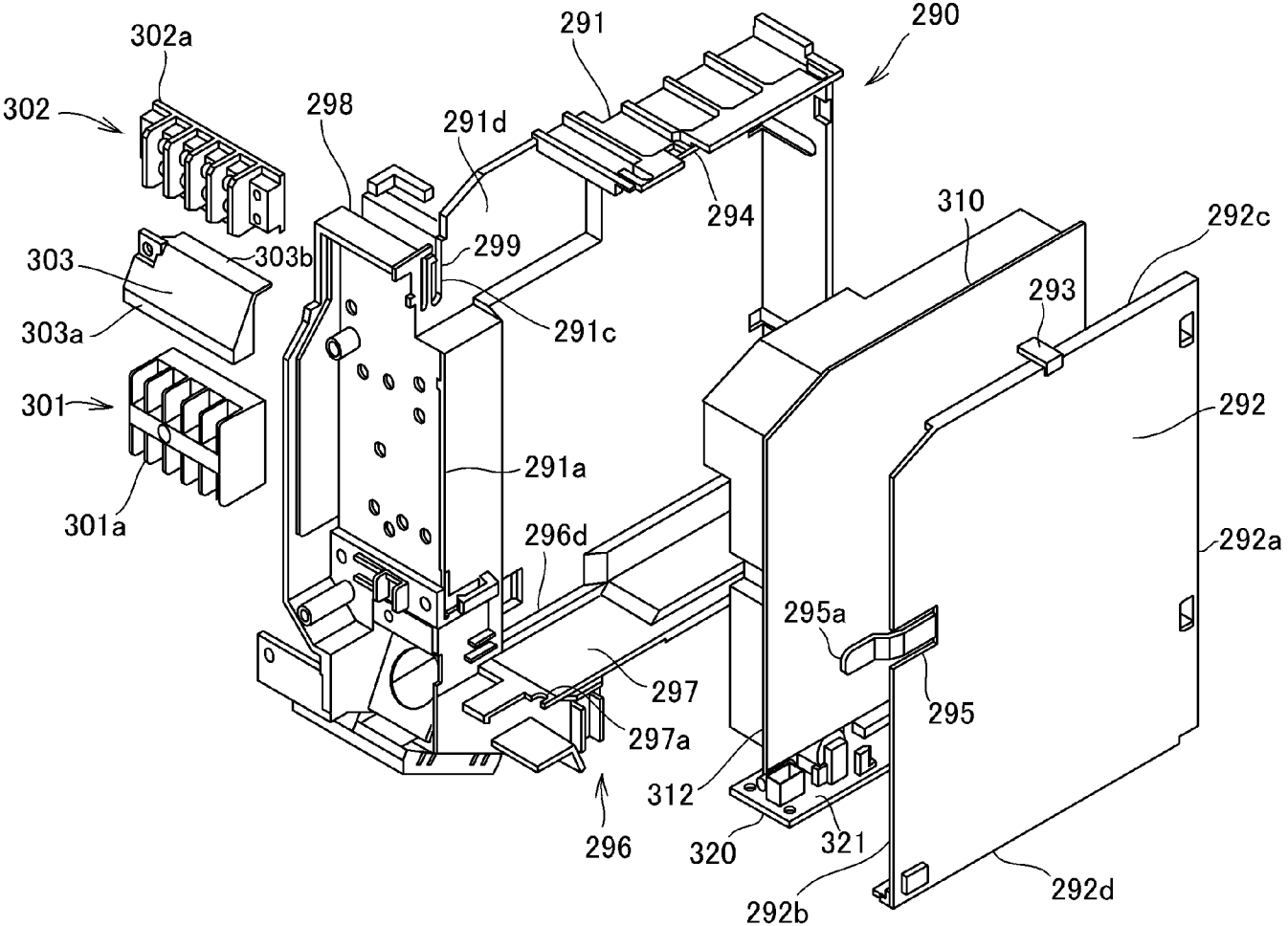
FIG. 12 is a perspective exploded view of the electric equipment box of the third embodiment.
Figure 13B:
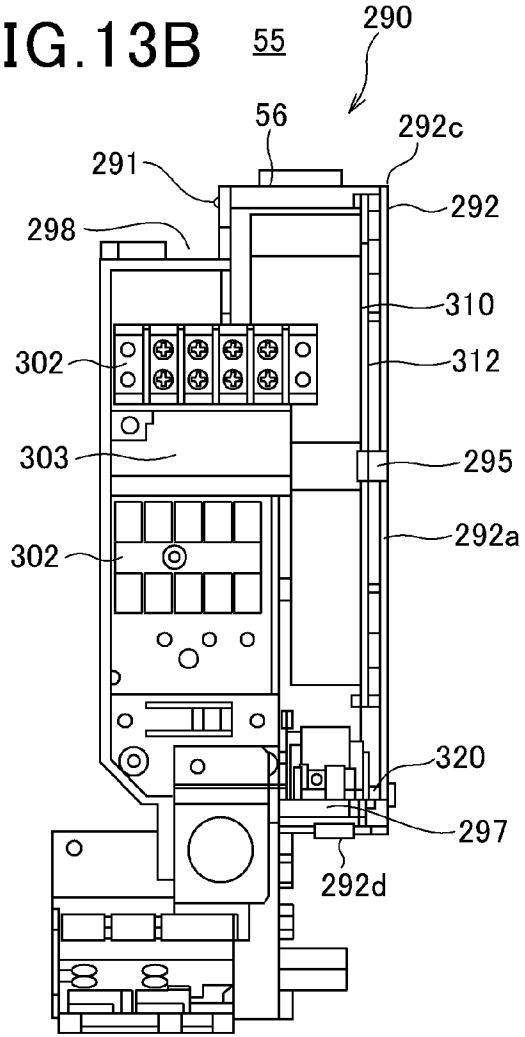
FIG. 13A is a side view on the side of the outer plate of the electric equipment box of the third embodiment and FIG. 13B is a front view thereof.
Figure 13A:
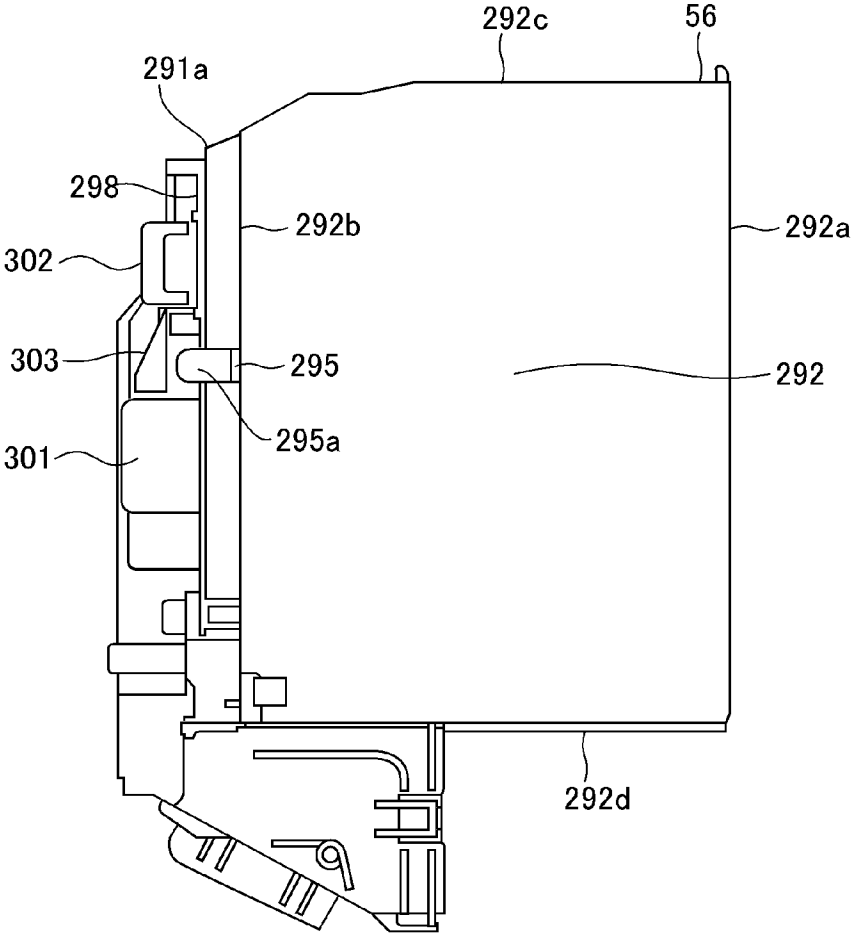
Figure 14:
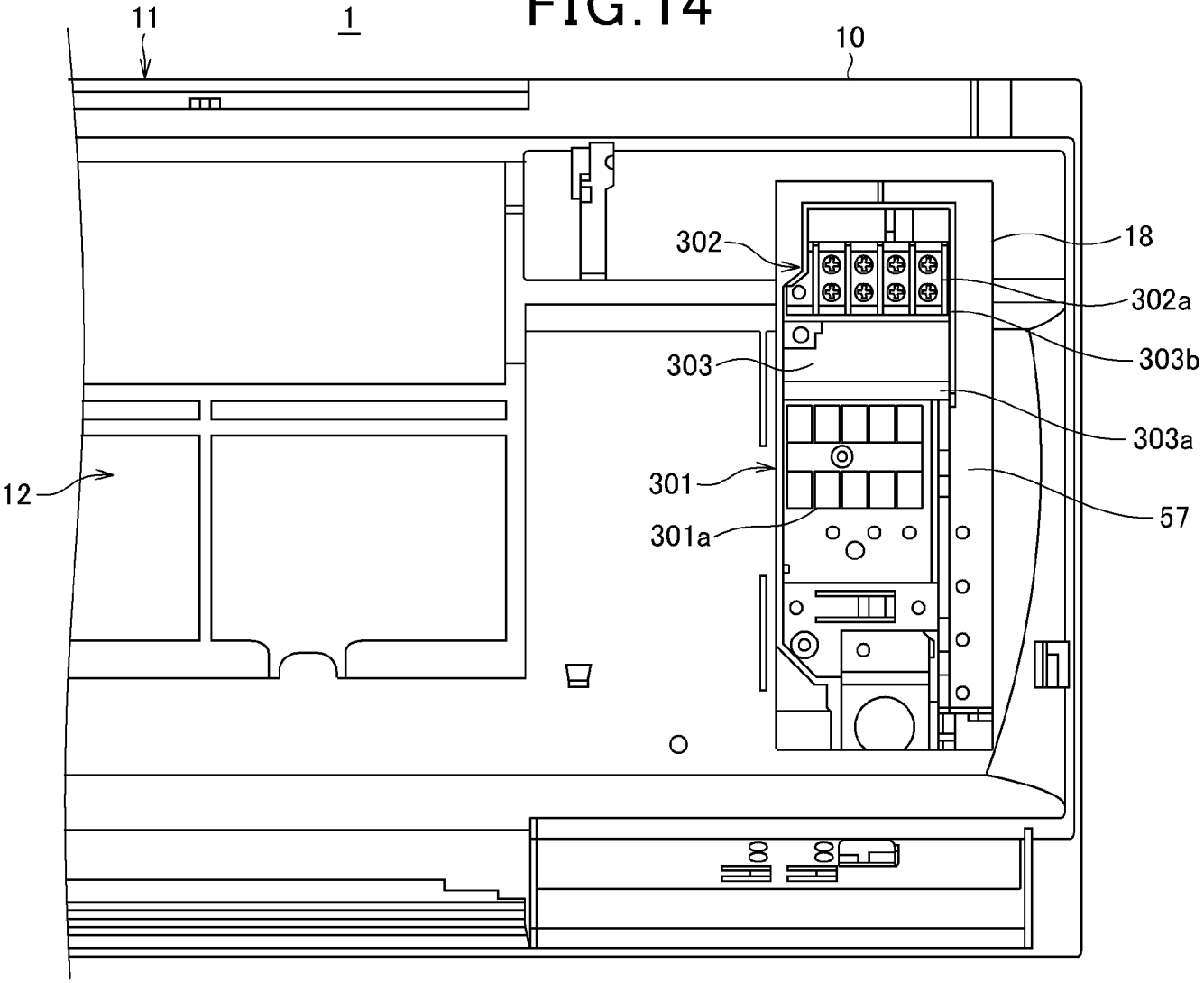
FIG. 14 is a front view partially illustrating the wall-hung air conditioner of the third embodiment in a state in which a front panel is removed.
Figure 15:
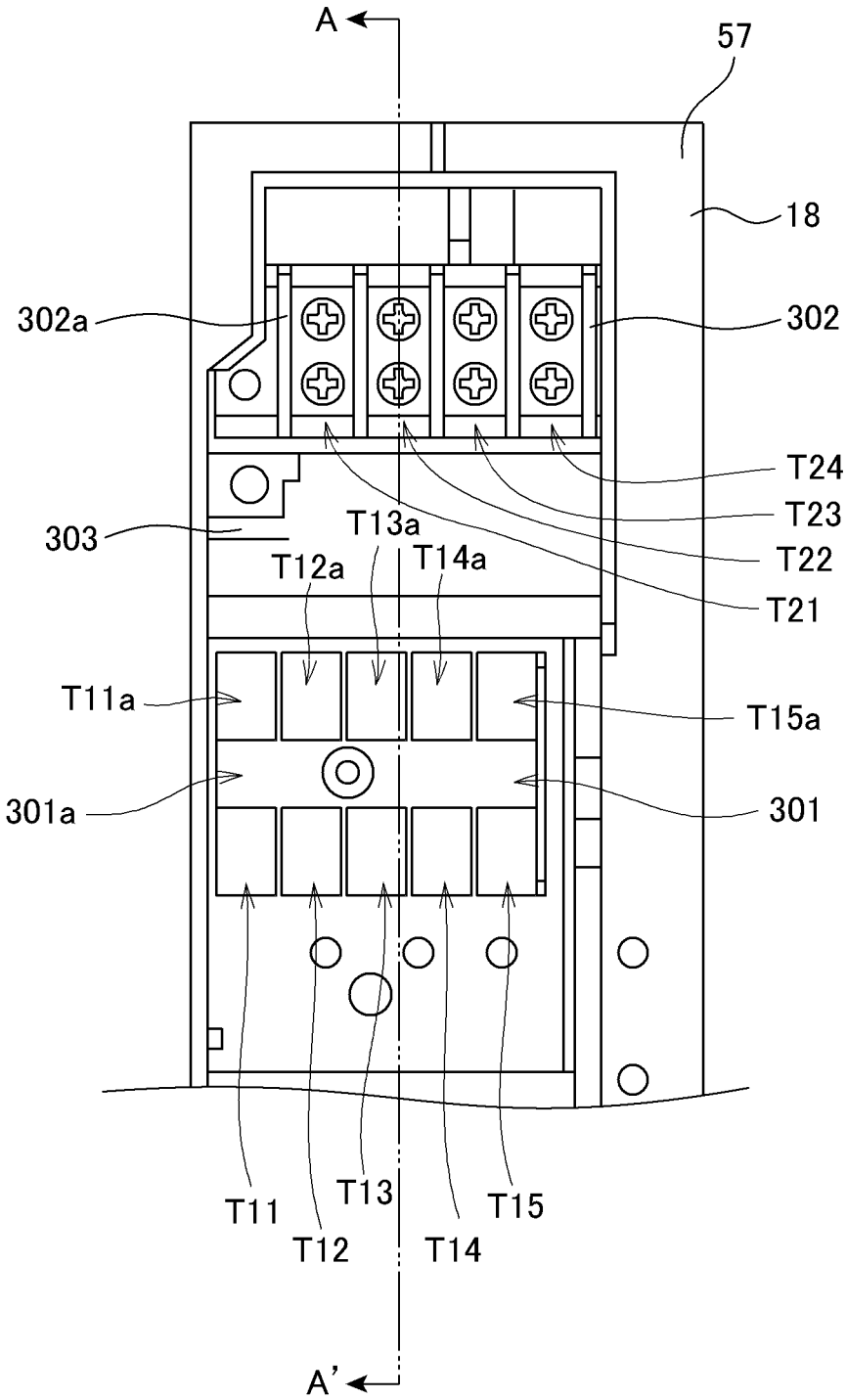
FIG. 15 is a front view of a first terminal block and a second terminal block disposed in the electric equipment box of the third embodiment.
Figure 16:
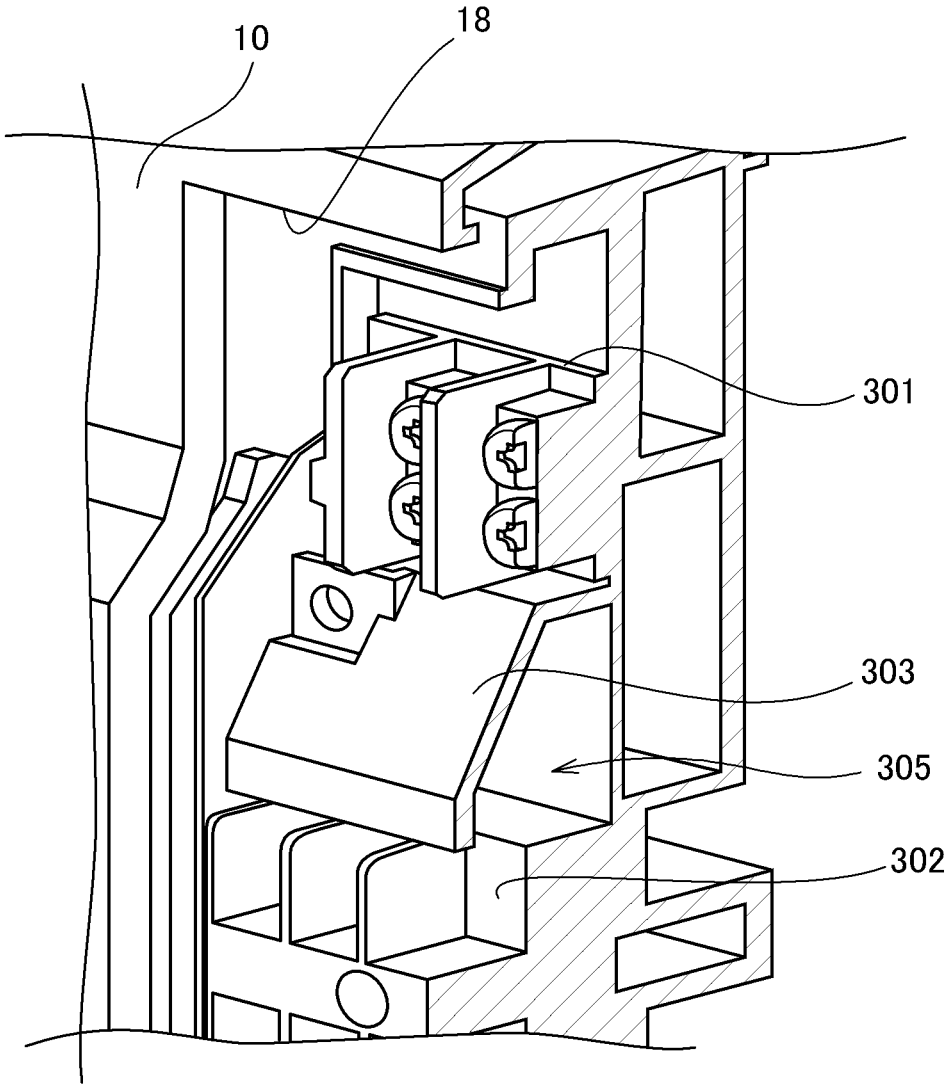
FIG. 16 is a perspective sectional view illustrating the first terminal block, the second terminal block, and a wiring partition plate of the third embodiment.

Here, FIGS. 10 to 16 show a configuration of the electric equipment box 55. FIG. 10 is a perspective view showing the electric equipment box 55 of the wall-hung air conditioner 1 according to this third embodiment from the side of an outer plate 292. FIG. 11 is a perspective view illustrating a state in which the outer plate 292 of the electric equipment box 55 is opened. FIG. 12 is a perspective exploded view of the electric equipment box 55. FIG. 13A is a side view of the electric equipment box 55 on the side of the outer plate 292, and FIG. 13B is a front view of the electric equipment box 55. FIG. 14 is a front view illustrating a part of the wall-hung air conditioner 1 from which the front panel 16 is removed, and FIG. 15 is a front view illustrating a first terminal block 301 and a second terminal block 302. Moreover, FIG. 16 is a perspective sectional view illustrating a part of the section in an A-A' line shown in FIG. 15.

However, in side plates of the electric equipment box 55, a side plate arranged on the heat exchange unit 20 side is an inner plate 291 and a sideplate opposite to this inner plate 291 is the outer plate 292. Also, the side where the first terminal block 301 and the second terminal block 302 are disposed is the front side, while the side of the installation plate 50 is the depth side.

As shown in FIGS. 10 to 16, the electric equipment box 55 includes an electric equipment box main body 290 provided with the inner plate 291 and the outer plate 292 that is hinge-connected to this electric equipment box 55, capable of being opened/closed. As shown in FIG. 11, in the outer plate 292 of the electric equipment box 55, a depth end 292*a* is hinge-connected to the electric equipment box main body 290, and a front end 292*b* is formed on the side, capable of being opened/closed. Substantially at the center position of an upper end 292*c* of the outer plate 292, a claw portion 293 that locks the outer plate 292 to the electric equipment box main body 290 is disposed. By locking the claw portion 293 to a receiving portion 294 formed in the electric equipment box main body 290, the outer plate 292 is closed. However, FIG. 10 shows a state in which a top cover 56 covers the upper part of the electric equipment box main body 290.

On the rear face of the outer plate 292, a main substrate 310 (first substrate) is attached. Substantially at the center position of the front end 292*b* of the outer plate 292, a lock portion 295 that detachably locks the main substrate 310 is disposed, and a lower end 311 of the main substrate 310 is supported by a rail 296*a*, which will be described later. When the outer plate 292 is opened, the main substrate 310 is moved along with the outer plate 292 in a state in which a lower end 311 thereof is supported by the rail 296*a* and a front end 312 is locked by the locking portion 295. Therefore, with a maintenance agency or the like who opened the outer plate 292, an equipped face of electronic components of the main substrate 310 is faced. Also the locking portion is constructed of a member capable of being elastically deformed. And if a force to open a front end portion 295*a* of the locking portion 295 outward is applied, engagement between the locking portion 295 and the main substrate 310 is released. Therefore, if a maintenance agency or the like opens this locking portion 295 outward in a state in which the outer plate 292 is closed, the main substrate 310 can be withdrawn from the electric equipment box 55 in a state in which the electric equipment box 55 is assembled to the frame 3. However, FIG. 11 shows a state in which only the outer plate 292 is opened.

Also, as shown in FIGS. 10 and 13B, a portion between the inner plate 291 and the outer plate 292 is opened. The front end 312 side of the main substrate 310 contained in the electric equipment box main body 290 is exposed from this opening. Below the main substrate 310, that is, at a position that avoids the electronic components (attached components) attached to the main substrate 310, a sub substrate 320 (second substrate) is contained. The sub substrate 320 can be withdrawn from the electric equipment box 55 through this opening by a guiding portion 296. The guiding portion 296 includes the rail 296*a* detachably attached to the rear face of the outer plate 292, a rail 296*b* disposed on the inner plate 291 and attached at a position opposite this rail 296*a*, and a sub substrate placement plate 297 detachably supported by these rails 296*a* and 296*b*. Ata front end of the sub substrate placement plate 297, a locking portion 297*a* is formed so that the sub substrate 320 placed on the sub substrate placement plate 297 is prevented by this locking portion 297*a* from jumping out to the outside of the electric equipment box 55.

The sub substrate 320 is placed on this sub substrate placement plate 297 and contained in the electric equipment box 55. As a result, the sub substrate 320 is guided by the guiding portion 296 and can be withdrawn to the front from the electric equipment box 55.

On the front side of the electric equipment box 55, a front face plate 298 consecutively connected to the front end 291*a* of the inner plate 291 is disposed so as to protrude to the side of the heat exchange unit 20. However, in this embodiment, in the upper part on the front end 291*a* side of the inner plate 291, a recess portion 291*b* that protrudes to the heat exchange unit 20 side is formed in order to contain large-sized electronic components attached to the main substrate 310.

On the front face plate 298, the first terminal block 301 and the second terminal block 302 are disposed with an interval in the vertical direction. Along with them, on the front face plate 298, a wiring partition plate 303 is disposed at the middle position between the first terminal block 301 and the second terminal block 302.

In the grill 10, at a position corresponding to the side of the heat exchange unit 20, that is, at a position corresponding to an arrangement position of the electric equipment box 55, an opening 18 is formed. If the front panel 16 is removed, these first terminal block 301, the wiring partition plate 303, and the second terminal block 302 disposed on the front face plate 298 of the electric equipment box 55 are exposed from the opening 18 of the grill 10. Also, the opening portion between the inner plate 291 and the outer plate 292 of the electric equipment box 55 is covered by a detachable front-face cover member and partially covered by the grill 10.

A lead wire (wire) (not shown) connected to the first terminal block 301 is connected to the main substrate 310. On the first terminal block 301, five pairs of connection terminals T11 to T15, in which two connection terminals form a pair, respectively, are disposed. These five pairs of connection terminals T11 to T15 are partitioned by an inter-terminal partition wall 301*a*.

The two pairs of connection terminals T11 and T12 arranged side by side on the heat exchange unit 20 side in the five pairs of connection terminals T11 to T15 disposed on the first terminal block 301 are connection terminals for power line connection. Also, the one pair of connection terminals T13 arranged at the center are connection terminals for earth line connection. The remaining two pairs of connection terminals T14 and T15 are connection terminals for communication wiring to which a communication wire with the outdoor unit is connected.

On the other hand, the lead wire (wire) (not shown) connected to the second terminal block 302 is connected to the sub substrate 320. On the second terminal block 302, four pairs of connection terminals T21 to T24, in which two connection terminals form a pair, are disposed.

The two pairs of connection terminals T21 and T22 arranged on the heat exchange unit 20 side in the four pairs of connection terminals T21 to T24 are connection terminals for remote controller wiring that wiredly connect a remote controller to the indoor unit 8. The remaining two pairs of connection terminals T23 and T24 are connection terminals to which a communication wiring for communication connection with a central controller is connected. However, in the wall-hung air conditioner 1 of this embodiment, a plurality of the indoor units 8 are connected to a single or a plurality of outdoor units so that the operation states of the indoor units 8 and the outdoor units can be controlled by the central controller. If an air conditioning system in which a plurality of the indoor units 8 are connected to a single or a plurality of outdoor units is configured, the sub substrate 320 is disposed in each of the indoor units 8 and the central controller is connected to the sub substrate 320 using the second terminal block 302 so that the indoor units 8 can be controlled by central control. Also, if being connected to the central controller, whether or not the remote controller is wiredly connected to the indoor unit 8 is an optional specification.

The wiring partition plate 303 is, as shown in FIGS. 12 and 14, inclined from the front to the depth so that a front end 303*a* approaches the upper part of the inter-terminal partition wall 301*a* of the first terminal block 301 and a depth end 303*b* approaches the lower part of the inter-terminal partition wall 302*a* of the second terminal block 302. In the lower part of the wiring partition plate 303, as shown in FIG. 16, a wiring space 305 for a lead wire connected to the first terminal block 301 is disposed, while in the upper part of the wiring partition plate 303, a wiring space for a lead wire connected to the second terminal block 302 is disposed.

The lead wires connected to connection terminals T11*a* to T15*a* (See FIG. 15) located on the wiring partition plate 303 side in the connection terminals T11 to T15 that are disposed on the first terminal block 301 and form pairs are connected to the main substrate 310 contained in the electric equipment box 55 from the front end 292*b* side of the inner plate 291 through the lower side of the wiring partition plate 303. However, as mentioned above, the opening portion between the inner plate 291 and the outer plate 292 of the electric equipment box 55 is covered by the detachable front face cover member 57 and partially covered by the grill 10. Therefore, the wire connected to the main substrate 310 is covered by the front face cover member 57, the grill 10, and this wiring partition plate 303, which prevents careless contact with the wire connected to the main substrate 310 by a user or a maintenance agency, for example.

Also, to the main substrate 310, lead wires (not shown) connected to the fan motor 46, the flap driving motor 63, and a temperature sensor are connected. These lead wires are inserted into the electric equipment box 55 through a vertically long lead-wire insertion hole 299 disposed in the front end portion 291*c* of the inner plate 291.

As mentioned above, according to the wall-hung air conditioner 1 according to this embodiment, the first terminal block 301 and the second terminal block 302 are disposed in advance in the electric equipment box 55, in which the first terminal block 301 is disposed as a terminal block to which the main substrate 310 for operation control of the indoor unit 8 is connected, while the second terminal block 302 is disposed as a terminal block for adding a component corresponding to an optional specification such as the sub substrate 320 or the like. Therefore, in the case of later addition of a component corresponding to an optional specification after the installation of the indoor unit 8 such that connection is made to the central controller or the remote controller is to be connected wiredly, the wiring connection can be easily made on the spot using this second terminal block 302.

Also, according to the above-described third embodiment, the wire connected to the first terminal block 301 is connected to the main substrate 310 in the electric equipment box 55 through the lower side of the wiring partition plate 303. Therefore, by covering the wire connected to the first terminal block 301 by the wiring partition plate 303 so as to prevent careless contact by a maintenance agency or the like.

Also, interference between the wire connected to the first terminal block 301 and the wire connected to the second terminal block 302 can be prevented by the wiring partition plate 303.

Also, according to this embodiment, since the main substrate 310 and the sub substrate 320 are contained between the inner plate 291 and the outer plate 292 and the opening between the inner plate 291 and the outer plate 292 is covered by the detachable front face cover member 57, the contained portions of the main substrate 310 and the sub substrate 320 contained in the electric equipment box 55 is prevented from being exposed from the opening 18 of the grill 10.

Also, according to this embodiment, by opening the outer plate 292 of the electric equipment box 55 to the side, various works can be performed such as a connector insertion work with a component corresponding to an optional specification of the sub substrate 320 or the like involved in addition of a component corresponding to the optional specification of the sub substrate 320 or the like to the main substrate 310 contained in the electric equipment box 55.

Also, according to this embodiment, since the main substrate 310 is attached to the rear face of the outer plate 292, various works can be performed such as a connector insertion work with a component corresponding to an optional specification of the sub substrate to the main substrate 310 or the like involved in addition of a component corresponding to the optional specification of the sub substrate 320 or the like in a state in which the outer plate 292 is opened and the main substrate 310 is supported on the outer plate 292.

Also, according to this embodiment, if a control substrate such as the sub substrate 320 or the like is to be added as a component corresponding to an optional specification, the sub substrate 320 can be inserted through the opening disposed on the front face side of the electric equipment box 55 so as to be contained in the electric equipment box 55.

This third embodiment is one mode of the present invention and it is needless to say that changes can be made as appropriate in a range not departing from the gist of the present invention. For example, a component corresponding to an optional specification is not limited to the sub substrate 320 but it may naturally be addition of a component, a change, update and the like of a component involved in the specification change or the like.

Fourth Embodiment

Figure 17:
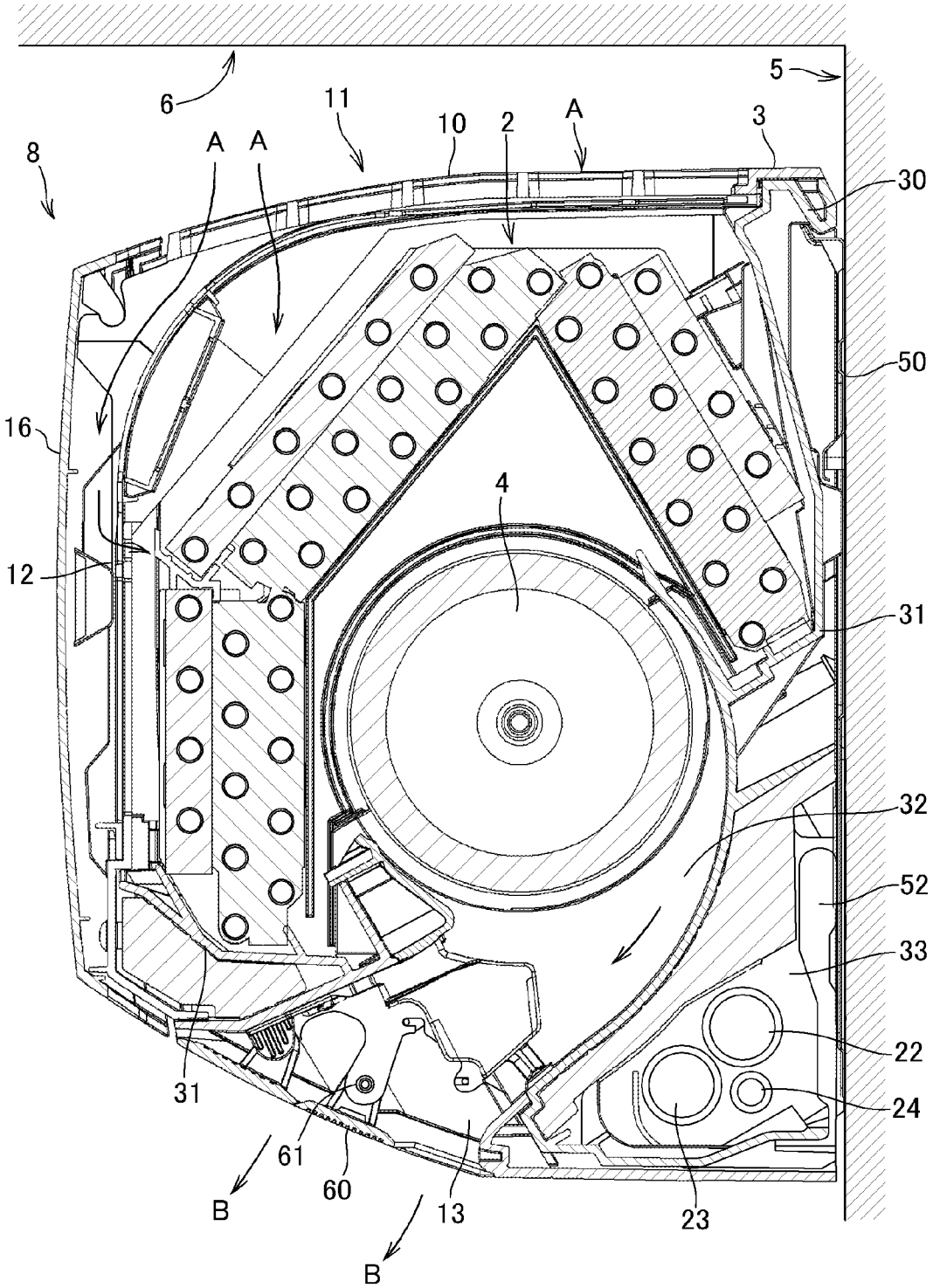
FIG. 17 is a sectional view of an indoor unit of the wall-hung air conditioner according to a fourth embodiment of the present invention.
Figure 18:
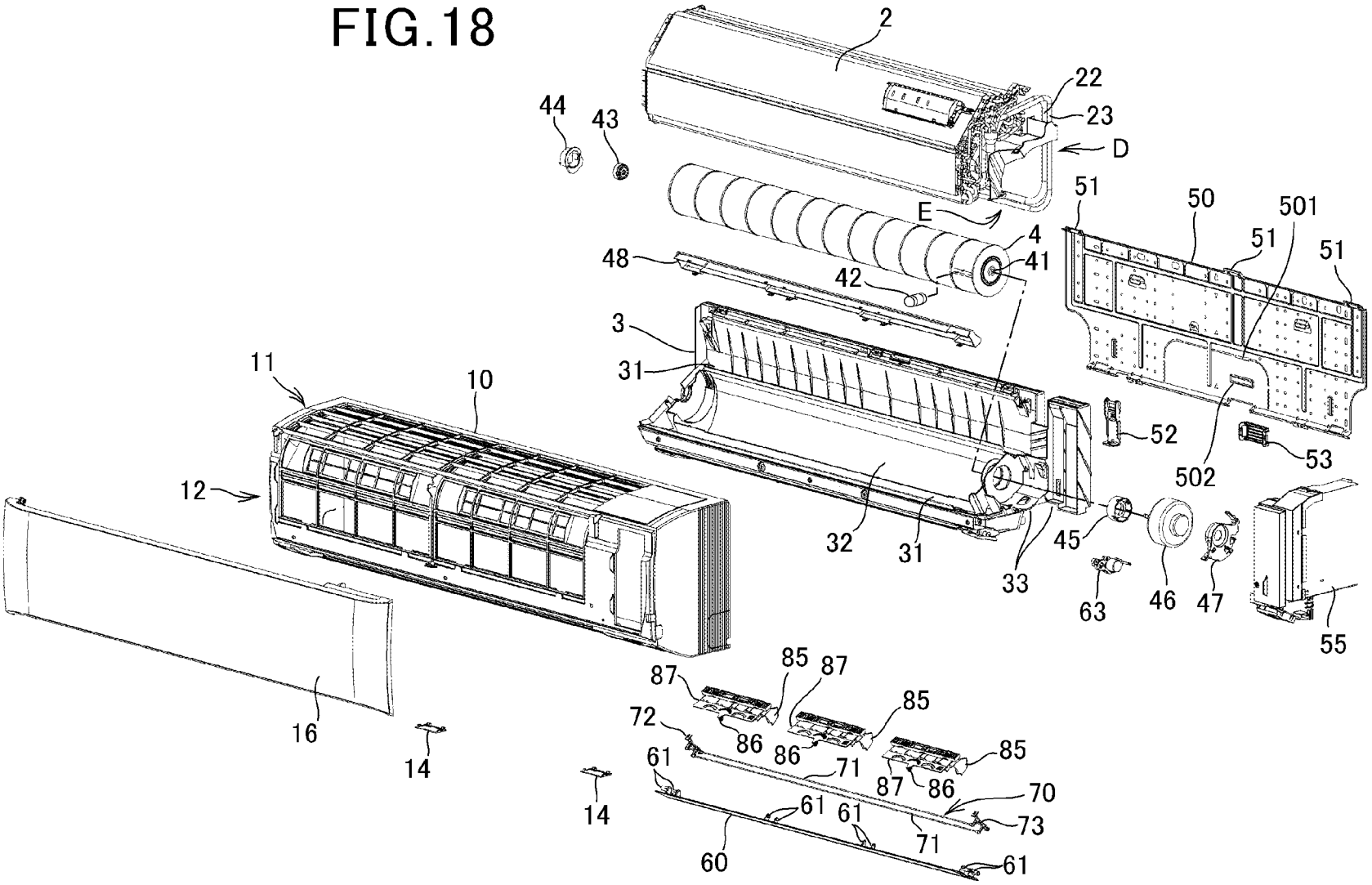
FIG. 18 is an exploded perspective view of the indoor unit shown in FIG. 17.

FIG. 17 is a sectional view of the indoor unit 8 in the wall-hung air conditioner according to a fourth embodiment to which the present invention is applied, and FIG. 18 is an exploded perspective view of the indoor unit 8.

The indoor unit 8 has the fin-and-tube type heat exchanger 2 formed with a substantially C-shaped section disposed in the frame 3 and has the blower (cross-flow fan) 4 arranged in the heat exchanger 2, and the heat exchanger 2 is covered by the grill 10. The frame 3 is a member formed having a substantially L-shaped section by resin molding, includes the drain pan 31 that receives drain water flowing down from the heat exchanger 2 and the scroll portion 32 that contains the blower 4, and the recess portion 30 that receives the locking claw 51 of the installation plate 50 is formed on the rear face of the frame 3. This frame 3 and the grill 10 constitute the housing of the indoor unit 8.

The blower 4 is constituted by a so-called cross-flow fan and contained between the tongue portion 48 and the scroll portion 32 that are disposed on the frame 3, and both ends of the blower 4 are supported by the frame 3 through the bearing portion 44 having the bearing 43 and the bearing portion 45.

The fan motor 46 is connected to one end of the blower 4, and the fan motor 46 is mounted on the frame 3 through the bearing 47. When explained in more detail, the hole 41 through which the rotation shaft of the fan motor 46 is inserted is disposed at one end of the blower 4, and the rotation shaft of the fan motor 46 inserted through this hole 41 is fixed to the blower 4 by the set screw 42 screwed from the side face of the blower 4. Also, the electric equipment box 55 is arranged on the side of the fan motor 46.

On a lower part and sides on the rear face side of the frame 3, the pipeline container portion 33, which is a space that contains refrigerant pipelines 22 and 23 and a drain pipeline 24, is formed, and the pipeline holder 53 that holds down a perpendicular portion D of the refrigerant pipelines 22 and 23 contained in the pipeline container portion 33 and the pipeline holder 52 that holds down a horizontal portion E of the refrigerant pipelines 22 and 23 and the drain pipeline 24 contained in the lower part of the pipeline container portion 33 are mounted. Here, the pipeline holder 52 is handled as the supporting member 52 for flip-up of the indoor unit 8 during an installation work of the indoor unit 8.

In the grill 10, the upper-face inlet 11 and the front-face inlet 12 are opened, and the front panel 16 is mounted so as to cover the front-face inlet 12, and indoor air flows into the indoor unit 8 from this grill 10 as shown by a solid line arrow A.

The blower 4 sucks indoor air from the upper-face inlet 11 and the front-face inlet 12 through the heat exchanger 2 and blows out the air heat-exchanged in the heat exchanger 2 from the outlet 13 opened on the lower face of the indoor unit 8 into a room to be air-conditioned as shown by a solid line arrow B through a space between the scroll portion 32 and the tongue portion 48.

The two flaps 60 as lateral blades for wind-direction change are disposed at the outlet 13. The flap 60 has the flap shaft 61 and is rotated vertically around the flap shaft 61. The two flaps 60 are driven in conjunction by the flap driving motor 63 so as to open/close the outlet 13 and also set a wind direction from the outlet 13 in the vertical direction.

Also, on the outlet side of the scroll portion 32, a plurality of the vertical blades 85 for wind-direction change are arranged side by side. The vertical blades 85 form a set of plural pieces (5 pieces in this embodiment) and connected by the link member 87 on the rear side of the scroll portion 32. The vertical blade 85 is connected to a vertical-blade driving motor (not shown) and changes its direction to right or left according to an operation of the vertical-blade driving motor or an operation of the operation lever 86.

Then, the fan guard 70 is disposed between the vertical blade 85 and the flap 60. The fan guard 70 is constituted by two wires 71 extended in parallel with each other along the longitudinal direction of the outlet 13 and the supporting bodies 72 and 73 that bundle the ends of the wires 71. The fan guard 70 prevents the hand from inserting into the depth of the outlet 13 by the wires 71.

Figure 19:
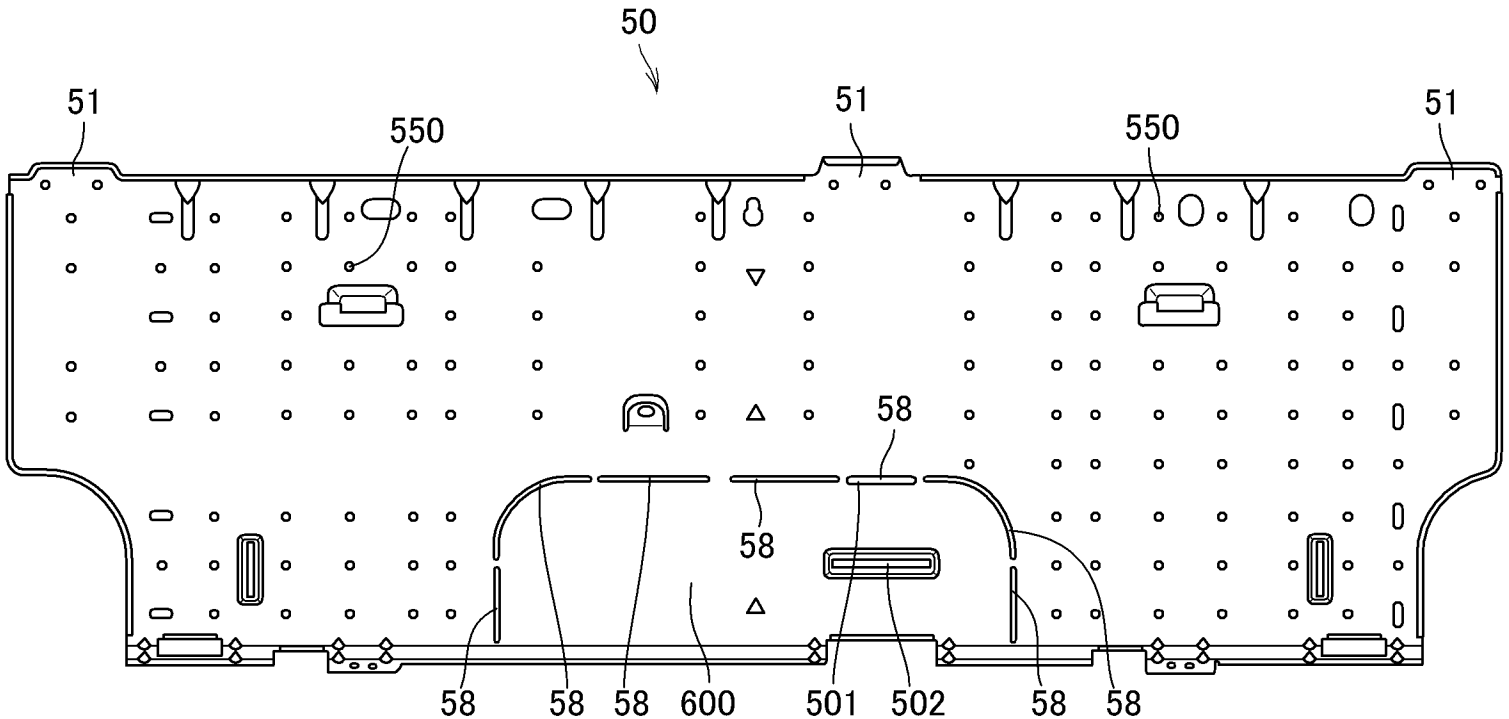
FIG. 19 is a detailed view of an installation plate shown in FIG. 17.

FIG. 19 is a detailed diagram of the installation plate 50 of the indoor unit 8 in the wall-hung air conditioner in this fourth embodiment.

In the upper part of the installation plate 50, the locking claw 51 that locks the recess portion 30 formed on the upper part on the rear face of the frame 3 in the indoor unit 8 when the indoor unit 8 is installed on the wall face 5 is disposed. During a piping work, the indoor unit 8 is rotated and flipped up using the locking claw 51 portion as a fulcrum.

In the lower part of the installation plate 50, mounting holes 501 and 502 engaged with a supporting member 52 that ensures a working space during the piping work are formed. By disposing the two mounting holes 501 and 502, angles θ1 and θ2 formed by the supporting member 52 and the installation plate 50 are changed as shown in FIG. 20, and the flip-up height of the indoor unit 8 can be adjusted (which will be described later).

Also, on this installation plate 50, a knock-out hole portion 600 that determines the taking-out positions of the refrigerant pipelines 22 and 23 and the drain pipeline 24 extended from the indoor unit 8 to the center of the installation plate 50 is disposed, and slits 58 are formed around it. That is, if the refrigerant pipelines 22 and 23 and the drain pipeline 24 are to be led out from the center of the installation plate 50 to the outside of the room, a cutting tool (not shown) is inserted into this slit 58 so as to cut out between the slits 58 so as to remove the knock-out hole portion 600 from the installation plate 50, and the cut-out portion is made as the above-mentioned pipeline taking-out position.

Here, the mounting hole 501 is not newly disposed for engagement of the supporting member 52 but a part of the slits 58 in the knock-out hole portion.

In this installation plate 50, a large number of holes 550 are disposed in the vertical and lateral directions in an aligned state so that the installation plate 50 can be fixed to the indoor wall face 5 by inserting a screw in an arbitrary hole matching the position of a stud located inside the indoor wall for fixation when the installation plate 50 is placed on the indoor wall face 5.

Figures 20A, 20B:
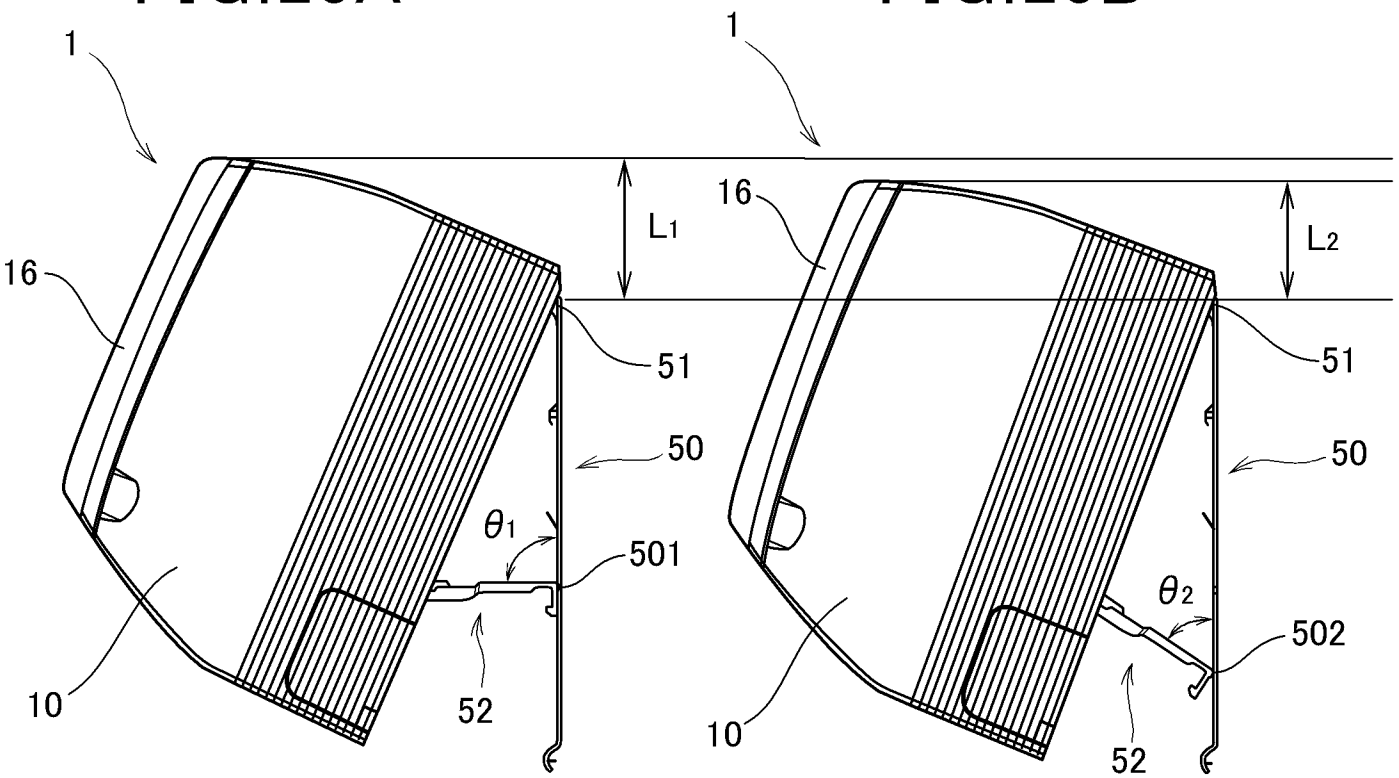
FIG. 20 are diagrams comparing the fourth embodiment and a fifth embodiment.
Figure 21:
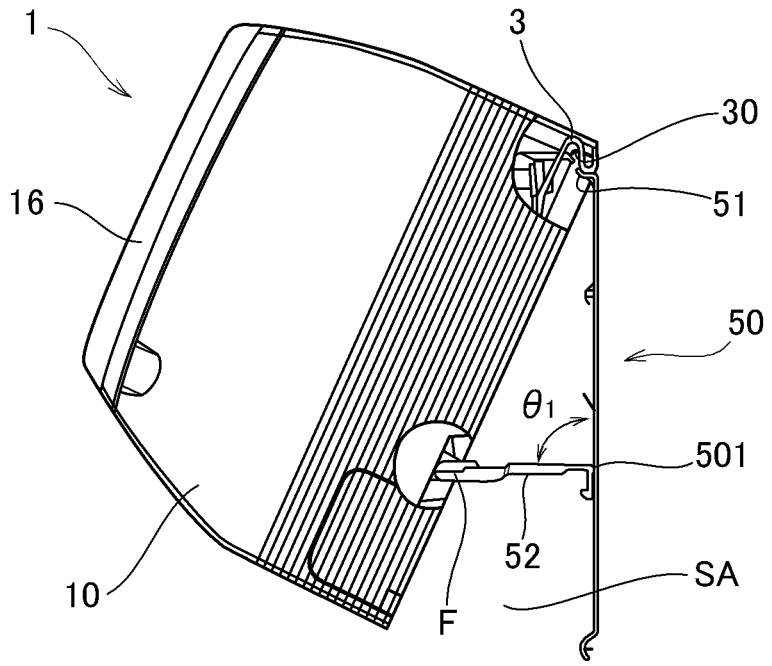
FIG. 21 is a diagram illustrating the fourth embodiment.
Figure 22:
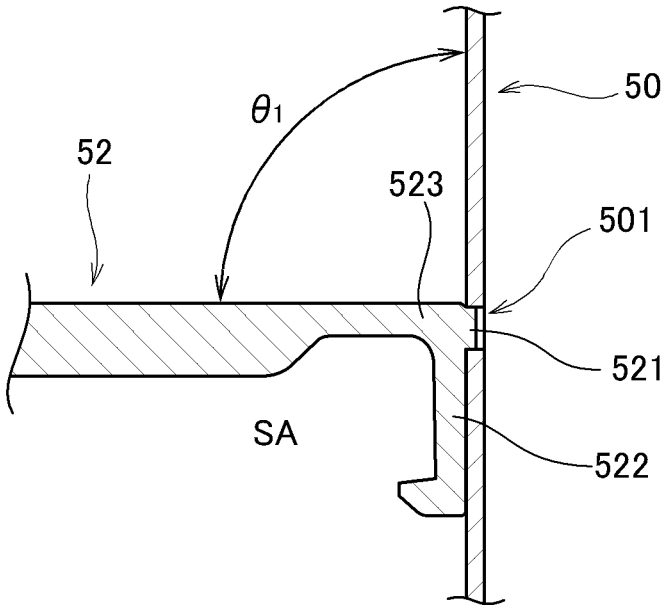
FIG. 22 is an enlarged view of an essential part of the fourth embodiment.
Figure 23:
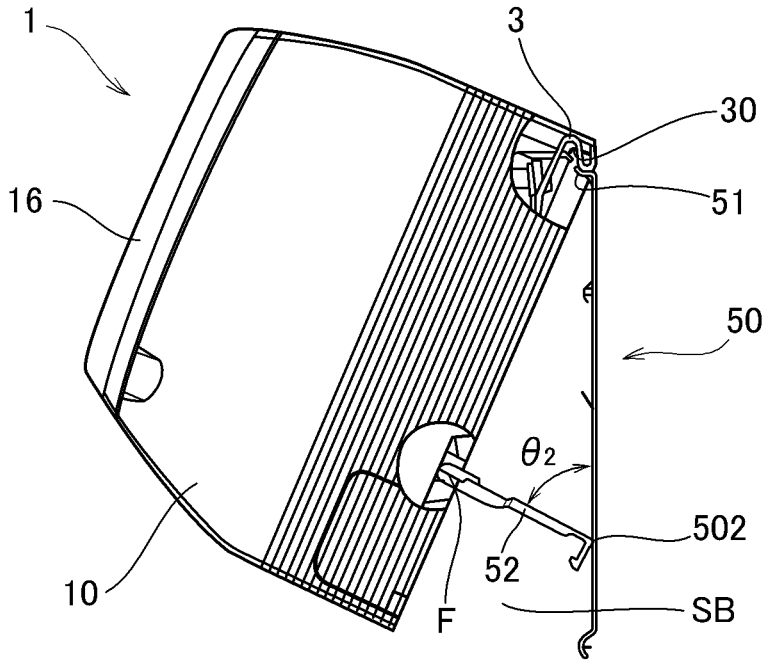
FIG. 23 is a diagram illustrating the fifth embodiment.
Figure 24:
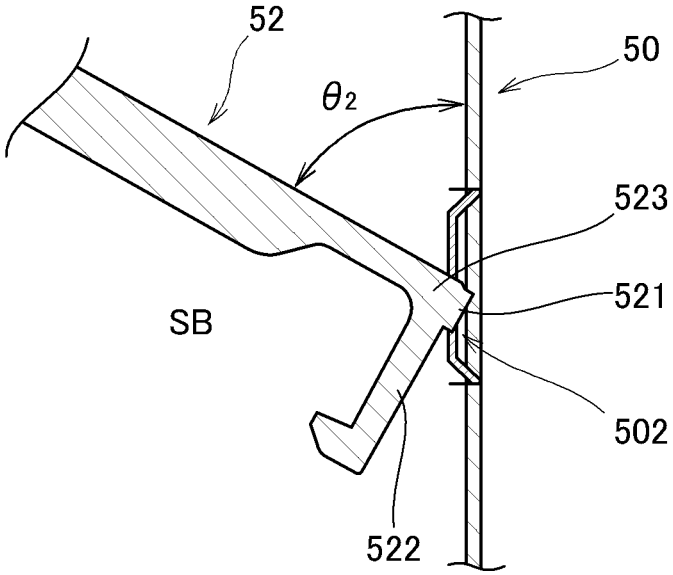
FIG. 24 is an enlarged view of an essential part of the fifth embodiment.

FIG. 20 is a diagram showing that the indoor unit 8 is flipped up using an adjustment mechanism of the installation plate 50 according to the present invention, in which FIG. 20A shows the fourth embodiment, and FIG. 20B shows a fifth embodiment. FIG. 21 is a partially broken diagram of the indoor unit 8 in the fourth embodiment, and FIG. 22 is an enlarged view of the essential part thereof. FIG. 23 is a partially broken diagram of the indoor unit 8 in the fifth embodiment, and FIG. 24 is an enlarged view of the essential part thereof.

If the indoor unit 8 is to be installed on the indoor wall face 5, the installation plate 50 is attached to the wall face 5, and the installation position of the indoor unit 8 is determined by fixation of this installation plate 50.

After the installation plate 50 is attached, the upper part (the recess portion 30 of the frame 3) of the indoor unit 8 is locked by the locking claw 51 of the installation plate 50 and used as a fulcrum, the upper part of the indoor unit 8 is flipped up. At the same time, the supporting member 52 on the rear face of the indoor unit 8 is rotated around the fulcrum F and raised up, the front part thereof (which will be described later) is engaged with the mounting hole 501 or 502 disposed in the installation plate 50 and the supporting member 52 of the indoor unit 8 so as to flip up the upper part of the indoor unit 8. Then, working spaces SA and SB are ensured in the lower part of the indoor unit 8, and a refrigerant pipeline from the indoor unit, not shown, is connected to the refrigerant pipelines 22 and 23 of the indoor unit 8. Moreover, a piping work to connect an extension pipeline (not shown) to the drain pipeline 24 is performed.

This supporting member 52 has an L-shape in which the front part thereof is bent downward, a projection portion 521 is formed between a plane portion 522 on the front part and a bent portion 523, and there is an effect to stabilize the supporting member 52 by engaging the projection portion 521 with the mounting holes 501 and 502.

If there is a sufficient distance from the installation position of the indoor unit 8 to the ceiling 6 in the room (FIGS. 20A, 21, and 22), the supporting member 52 of the indoor unit 8 is rotated around the fulcrum F so as to bring this supporting member 52 into the substantially horizontal state. The angle θ1 formed by the supporting member 52 and the installation plate 50 is set at approximately 90 degrees, and the plane portion 522 on the front part of the supporting member 52 is engaged with the mounting hole 501. At this time, by locking the projection portion 521 of the supporting member 52 by the mounting hole 501, engagement of the supporting member 52 with the installation plate 50 is stabilized, the flip-up height of the indoor unit 8 becomes L1, and the sufficient working space SA is ensured. The refrigerant pipelines 22 and 23 and the drain pipeline 24 are contained in this working space SA, and the above-mentioned piping work is performed.

After that, with respect to the refrigerant pipelines 22 and 23 and the drain pipeline 24, the supporting member 52 is removed from the mounting hole 501 and rotated downward, these pipelines are contained in the lower part of the indoor unit 8 by the L-shape of the supporting member 52, and the indoor unit 8 is brought into the perpendicular state with respect to the indoor wall face 5 and the installation work is completed. That is, when the installation work is completed, the supporting member 52 in the L-shape also functions as a pipeline holder for determining the positions of the refrigerant pipelines 22 and 23 and the drain pipeline 24.

If the installation position of the indoor unit 8 is close to the ceiling 6 in the room (FIGS. 20B, 23, and 24), that is, if the distance between the installation position of the indoor unit 8 and the ceiling 6 is smaller than L1, the supporting member 52 is rotated as mentioned above and the angle θ2 formed with the installation plate 50 is set at approximately 90 degrees or less, and the bent portion 523 on the front part of this supporting member 52 is engaged with the mounting hole 502.

At this time, by locking the projection portion 521 of the supporting member 52 in the mounting hole 502, the engagement of the supporting member 52 with the installation plate 50 is stabilized, the flip-up height of the indoor unit 8 becomes L2, which is smaller than L1, and the safe working space SB can be ensured. The piping work after that is as mentioned above.

As mentioned above, the adjustment mechanism that adjusts the flip-up height of the upper part of the indoor unit 8 is constituted by the supporting member 52 and the mounting holes 501 and 502 disposed in the installation plate 50. In the above embodiment, the flip-up height of the upper part of the indoor unit 8 can be adjusted by using the above adjustment mechanism according to the interval between the ceiling 6 and the indoor unit 8, and the safe working spaces SA and SB can be ensured between the installation plate 50 and the indoor unit 8.

Therefore, if the installation position of the indoor unit 8 is close to the ceiling 6 in the room as before, the problem that if the supporting member 52 is sandwiched, the indoor unit 8 is brought into contact with the ceiling 6 and the indoor unit 8 cannot be fixed in the flip-up state can be solved.

Figure 25:
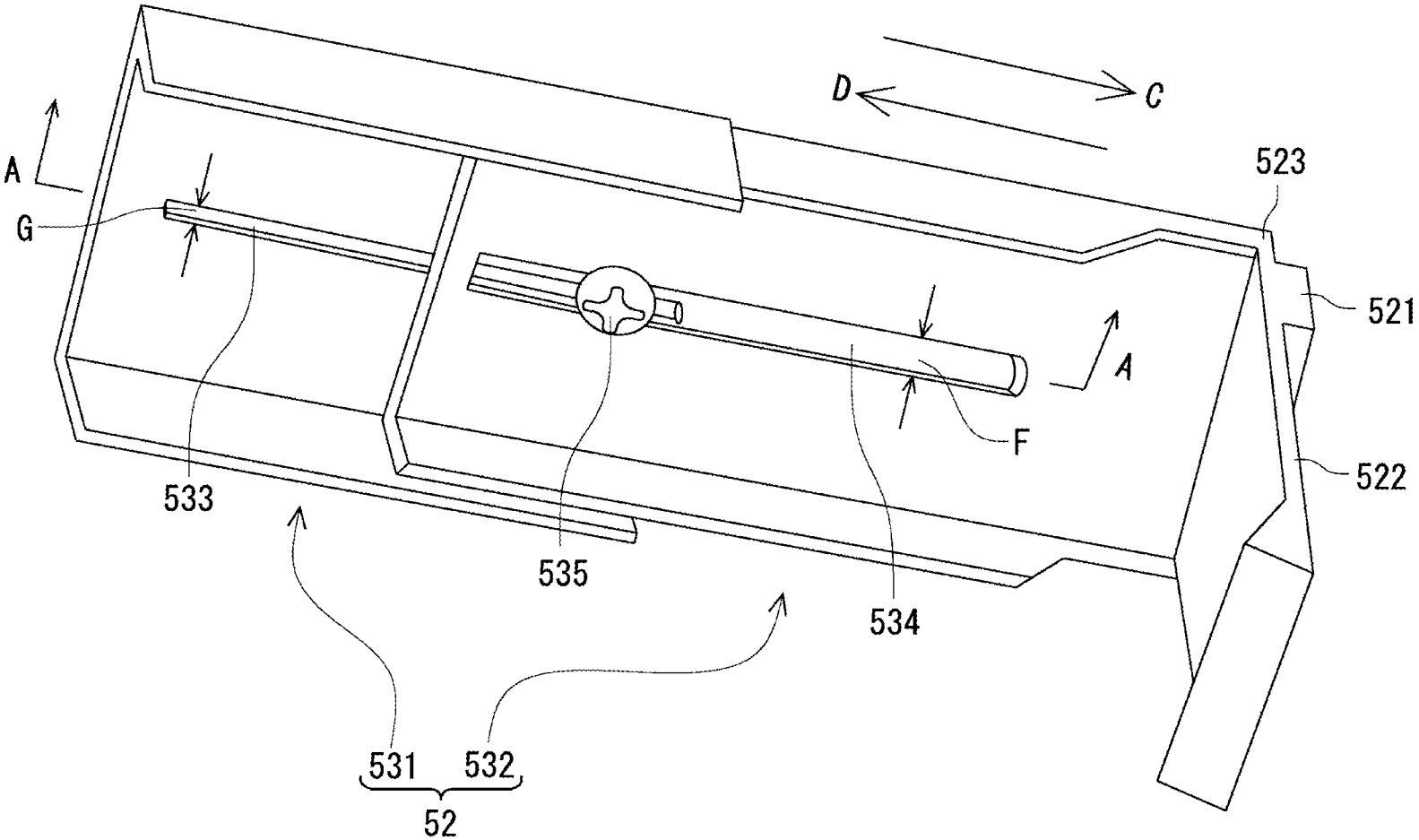
FIG. 25 is a detailed configuration diagram illustrating another embodiment of a supporting member shown in FIG. 21.
Figure 26:
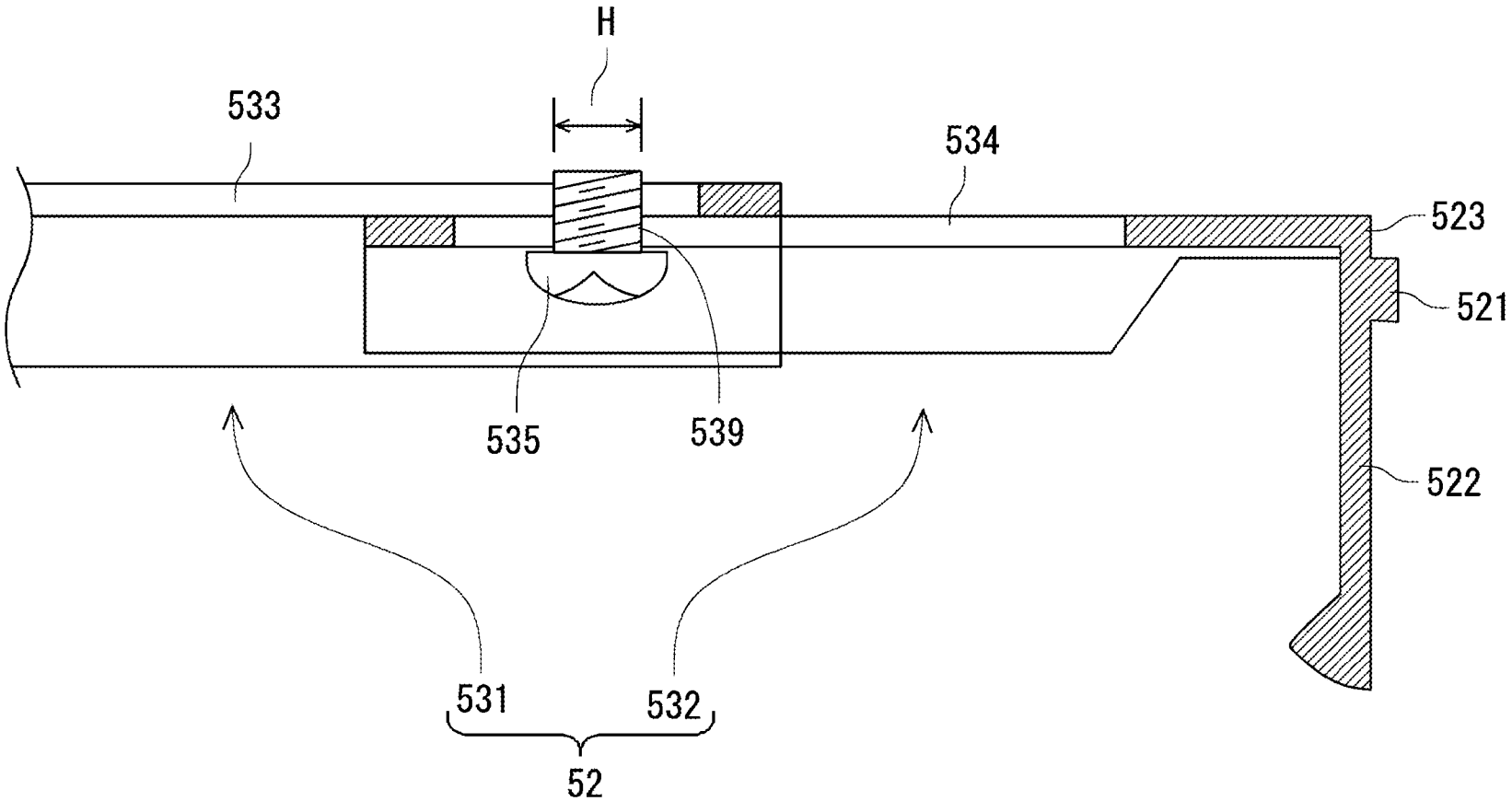
FIG. 26 is an A-A sectional view of FIG. 25.

FIG. 25 shows another fourth embodiment of the supporting member 52 shown in FIG. 21, and FIG. 26 shows an A-A sectional view of FIG. 25. In these figures, the supporting member 52 is rotatably disposed in the indoor unit 8 (See FIG. 17) and is constituted by a first supporting tool 531 substantially in the U-shape and an L-shaped second supporting tool 532 with the front part thereof bent downward and locked by the supporting member 52.

In the supporting tools 531 and 532, slits 533 and 534 are disposed in the longitudinal direction, respectively, and the two slits 533 and 534 are constructed such that the two slits 533 and 534 are overlapped with each other when these two supporting tools 531 and 532 are overlapped. Here, a width G of the slit 533 is set smaller than a width F of the slit 534.

A screw 535 is inserted from below into the slits 533 and 534 in the overlapped state (from the space SA side in FIG. 21). A width dimension H of a screw portion 539 in the screw 535 (See FIG. 26) substantially matches the width G of the slit 533 (See FIG. 25).

Therefore, by inserting the screw 535 into the supporting member 52 from below, the screw portion 539 of the screw 535 is engaged in the slit 533 while the slit 532 maintains the gap.

That is, when the screw 535 is attached to the supporting member 53, in the supporting member 52, the second supporting tool 532 is telescopically moved in directions shown by arrows CD with respect to the first supporting tool 531 extending from the indoor unit 8. When the screw 535 is firmly tightened to the slit 533, the first supporting tool 531 and the second supporting tool 532 are fixed by this screw 535.

Also, referring to FIGS. 21 and 23, since the supporting member 52 can ensure a wider space if it is horizontal with respect to the working space SA or SB (FIG. 21), the piping work can be performed easily. Therefore, in the above embodiment, the engagement of the supporting member 52 to the installation plate 50 is preferably done so that the supporting member 52 holds the horizontal state using the mounting hole 501.

Moreover, if the length of the supporting member 52 is constant, the flip-up height dimension of the indoor unit 8 can be adjusted only by the mounting holes 501 and 502 as shown in FIG. 21, but in the above embodiment, since the length of the supporting member 52 can be freely adjusted not in a stepped manner, the flip-up height of the indoor unit 8 can be also freely adjusted. Therefore, the space between the indoor unit 8 and the ceiling 6 can be effectively used, and the working space SA can be ensured.

That is, the flip-up height dimension L1 of the indoor unit 8 as shown in FIG. 20 can be adjusted by adjusting the length of the supporting member 52 so that the indoor unit 8 is inclined as much as possible, and the working space SA (See FIG. 21) can be ensured to the maximum, and the piping work can be performed easily.

Fifth Embodiment

Figure 27:
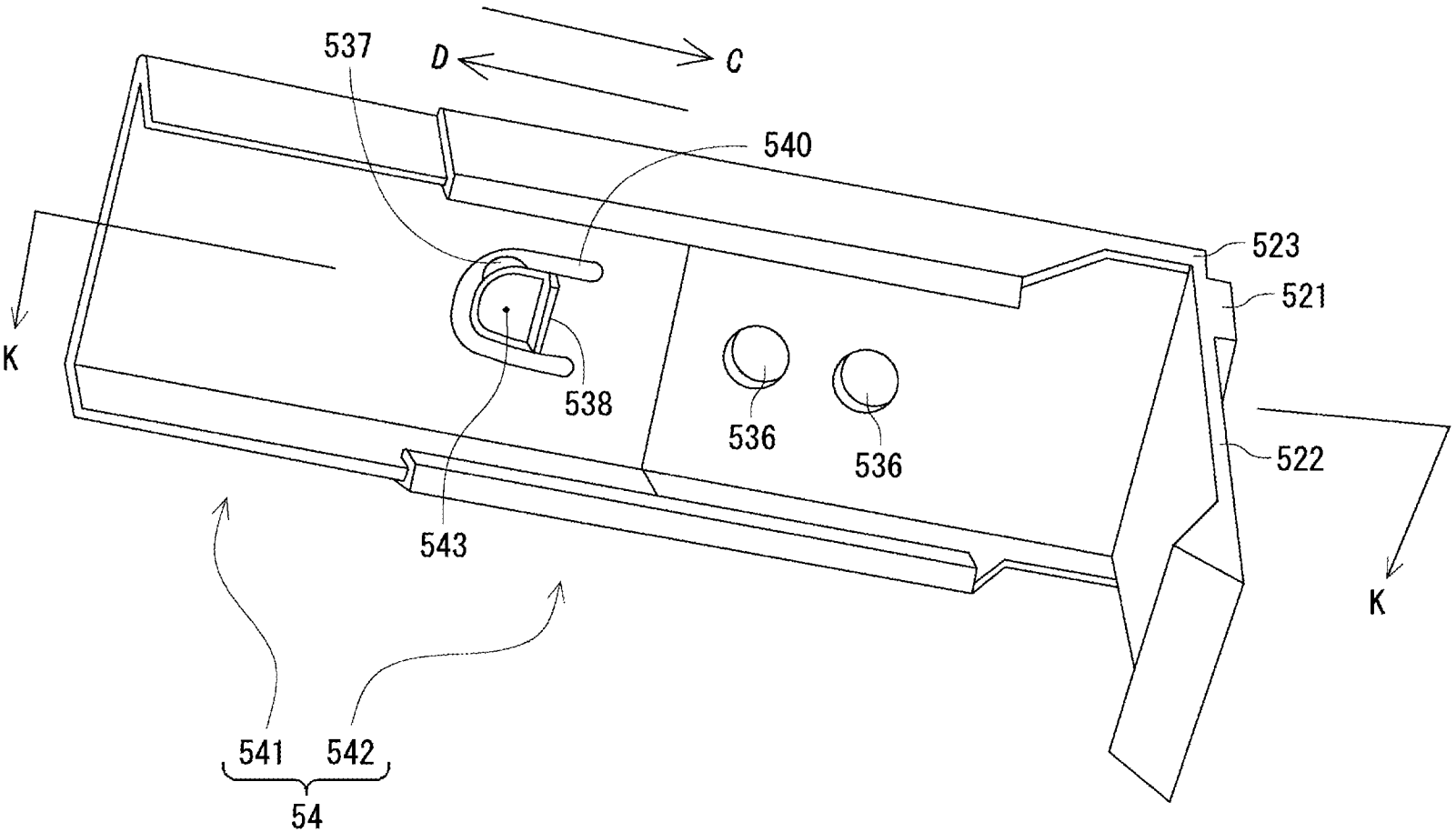
FIG. 27 is a detailed configuration diagram illustrating another embodiment of the supporting member shown in FIG. 21.
Figure 28:
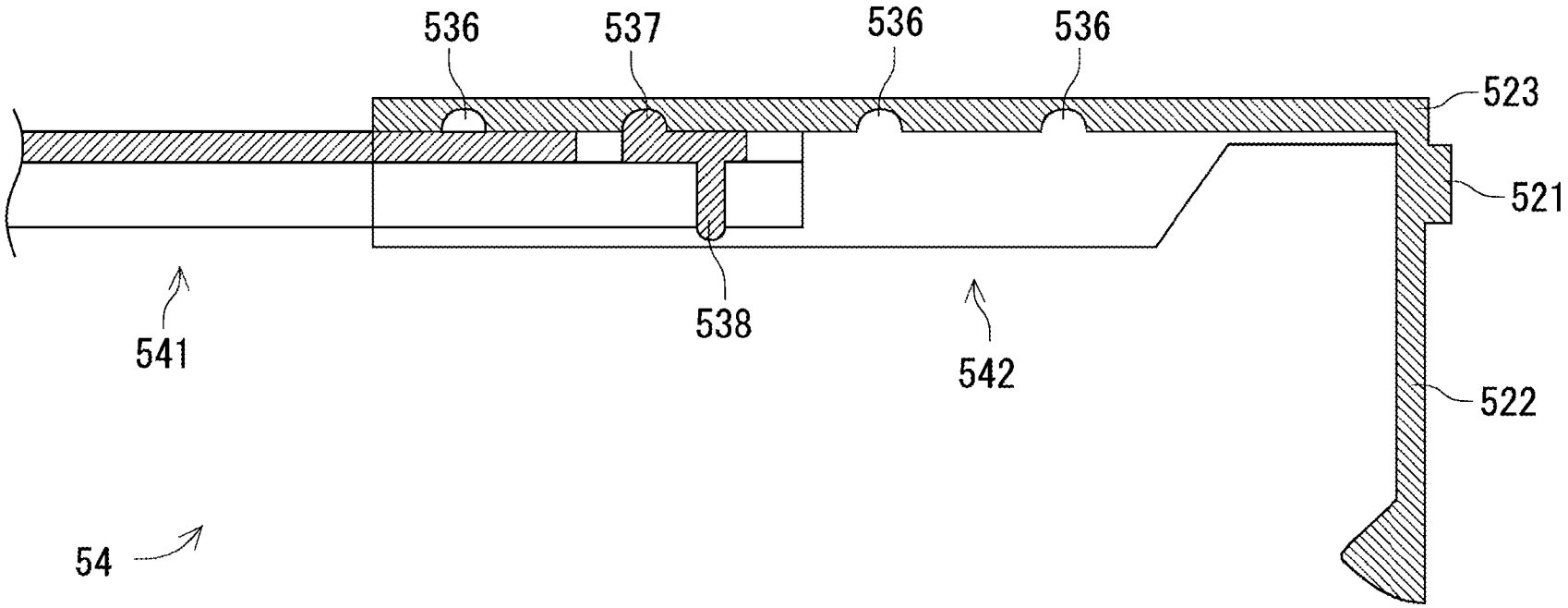
FIG. 28 is a K-K sectional view of FIG. 27.

FIG. 27 shows another fifth embodiment of the supporting member 52 shown in FIG. 21, and FIG. 28 shows a K-K sectional view of FIG. 27.

In these figures, a supporting member 54 has the U-shaped supporting tool 541 and the L-shaped supporting tool 542 whose front part is bent downward similarly to the above-mentioned another fourth embodiment.

A first supporting tool 541 is molded from an elastic member such as a synthetic resin, and a tongue piece 543 which is deformed in the vertical direction by a U-shaped slit 540 is formed. A lug 538 is formed on the lower face of this tongue piece 543, and a projection portion 537 is formed on the upper face thereof. On the other hand, in the inner face of the second supporting tool 542, a large number of recess portions 536 are disposed in the groove direction. The first supporting tool 541 and the second supporting tool 542 are formed having the substantially U-shaped sections. Moreover, a bending piece 544 is further formed inside at the both ends of the second supporting tool 542.

Therefore, when the second supporting tool 542 is inserted into the first supporting tool 541, this second supporting tool 542 slides in the directions of the arrows CD with respect to the first supporting tool 541. At that time, the tongue piece 543 is curved downward during the sliding, but when the projection portion 537 is fitted in the recess portion 536, the both members are engaged with each other. In this engaged state, by further sliding the second supporting tool 542 in the directions of the arrows CD, the engaged state between the recess and projection portions 537 and 536 are disengaged and the tool is moved to the subsequent recess and projection portions and engaged. With this structure, the supporting member 54 can move telescopically in a stepped manner in the directions of the arrows C, D by the number of the recess portions 536.

In this fifth embodiment, too, the flip-up height L1 of the indoor unit 8 can be adjusted by adjusting the length of the supporting member 54 so that the indoor unit 8 can be inclined as much as possible, the working space SA (See FIG. 21) can be ensured to the maximum, and the piping work can be performed easily.

Therefore, according to the above two other embodiments, even if the installation position of the indoor unit 8 is close to the ceiling 6 in the room as before, by adjusting the lengths of the supporting members 52 and 54, the problem that the indoor unit 8 is brought into contact with the ceiling 6 and the indoor unit 8 cannot be fixed in the flip-up state can be solved.

The invention claimed is:

1. A wall-hung air conditioner comprising a vertical blade and a lateral blade for wind-direction change and a fan guard at an outlet of a housing containing a heat exchanger and a blower, wherein:

the fan guard is provided with a plurality of wires extending in a longitudinal direction of the outlet and a pair of supporting bodies bundling both ends of the plurality of wires; and the fan guard is installed with the plurality of wires extended into a space between the vertical blade and the lateral blade and the pair of the supporting bodies fixed into the outlet through one-touch operation.

2. The wall-hung air conditioner according to claim 1, wherein a support is extended between an upper edge portion and a lower edge portion of the outlet; and the plurality of wires are locked by a receiving groove of the support.

3. The wall-hung air conditioner according to claim 2, wherein the receiving groove of the support is exposed to a front face side of the outlet.

4. The wall-hung air conditioner according to claims 1, wherein the supporting bodies are mounted between an upper edge portion and a lower edge portion of the outlet by elastically deforming at least either one of the upper edge portion or the lower edge portion.

5. The wall-hung air conditioner according to claim 4, wherein a projection is formed at either one of an upper end or a lower end of the supporting body, while a plate-shaped portion is formed on the other; and a hole engaged with the projection is formed in either one of the upper edge portion or the lower edge portion of the outlet, while a receiving portion that supports the plate-shaped portion is formed on the other.

6. The wall-hung air conditioner according to claim 1, further comprising a wire receiving portion that regulates movement in either upward or downward direction or in both the upward and downward directions of the plurality of wires is disposed on the vertical blade.

7. A wall-hung air conditioner comprising:

a heat-exchange unit that is integrally provided with a heat exchanger, a refrigerant pipe, a drain pan, and a cross-flow fan and is assembled and fixed to a frame;

a grill that covers the heat-exchange unit and is disposed on the front face of the frame; and an installation plate fixed to a wall in a room, the heat-exchange unit and the grill being mounted on the installation plate, wherein:

an opening and a cover covering the opening are disposed on a lower face of the grill, and a grill stopper portion that fixes the grill to the frame and a frame stopper portion that fixes the frame to the installation plate are integrally disposed in the opening which is exposed when the cover is opened.

8. The wall-hung air conditioner according to claim 7, wherein a plurality of openings are formed with an interval in a longitudinal direction on the lower face of the grill, and the grill stopper portion and the frame stopper portion are integrally disposed at each of the plurality of openings.

9. The wall-hung air conditioner according to claim 7, wherein the grill stopper portion is a portion that fixes the grill to the frame by a screw for grill fixation, and the frame stopper portion is a portion that fixes the frame to the installation plate by a screw for frame fixation.

10. The wall-hung air conditioner according to claim 9, wherein a top portion of the screw for grill fixation and a top portion of the screw for frame fixation are directed to a direction inclined forward to vertically below.

11. The wall-hung air conditioner according to claim 9, wherein a top portion of the screw for grill fixation and a top portion of the screw for frame fixation are directed to substantially the same direction.

12. The wall-hung air conditioner according to claim 9, wherein the screw for grill fixation and the screw for frame fixation are disposed with an interval in a longitudinal direction of the grill.

13. A wall-hung air conditioner comprising a heat exchanger, a drain pan, and a blower that are assembled and fixed to a frame and a grill that covers the heat exchanger and is disposed on the front face of the frame, wherein:

a vertically long electric equipment box is arranged on a side of the heat exchanger;

the electric equipment box is provided with a first terminal block and a second terminal block with an interval in a vertical direction and a wiring partition plate disposed in a middle position of the first and second terminal blocks;

the grill is provided with an opening that exposes the first terminal block, the wiring partition plate, and the second terminal block;

a wire connected to the first terminal block is connected to a substrate in the electric equipment box through a lower side of the wiring partition plate; and a wire connected to the second terminal block is connected to the substrate in the electric equipment box through an upper side of the wiring partition plate.

14. The wall-hung air conditioner according to claim 13, wherein the wire connected to the first terminal block is connected to a first substrate in the electric equipment box; and the wire connected to the second terminal block is connected to a second substrate in the electric equipment box.

15. The wall-hung air conditioner according to claim 13, wherein the electric equipment box includes an inner plate arranged on a heat exchanger side and an outer plate opposite to the inner plate, and the substrate is contained between the inner plate and the outer plate;

a front plate projecting to the heat exchanger side is disposed consecutively to a front end of the inner plate, and the first terminal block, the second terminal block, and the wiring partition plate are arranged on the front plate; and a portion between the inner plate and the outer plate is covered by a detachable front cover member.

16. The wall-hung air conditioner according to claim 15, wherein the outer plate hinge-connects a depth end so that the front end is formed so as to be capable of being opened/closed to a side.

17. The wall-hung air conditioner according to claim 16, wherein on a rear face of the outer plate, a first substrate to which the wire connected to the first terminal block is connected is mounted.

18. The wall-hung air conditioner according to claim 14, wherein an opening is disposed on a front face side of the electric equipment box, and the second substrate connected to the second terminal block through the opening is contained in the electric equipment box so as to be capable of being withdrawn forward.

19. An installing device for mounting an air conditioner to an installation plate fixed to a wall face, the installing device comprising:

an adjustment mechanism that changes a flip-up height of the air conditioner when the air conditioner is to be mounted to the installation plate, wherein:

the adjustment mechanism is disposed on the installation plate and/or the air conditioner, the adjustment mechanism comprises:

an L-shaped supporting member disposed on a rear side of the air conditioner rotatably in a front-and-rear direction; and a plurality of mounting holes provided to the installation plate, and the L-shaped supporting member is selectively fitted to one of the plurality of mounting holes so that an intersection angle between the L-shaped supporting member and the installation plate is changeable, thereby adjusting the flip-up height of the conditioner.

20. The installing device according to claim 19, wherein the supporting member has a plane portion on an L-shaped shorter side in the case of increasing the flip-up height of the air conditioner and an L-shaped bent portion in the case of decreasing the flip-up height fitted in the plurality of mounting holes, respectively.

21. The installing device according to claim 20, wherein the L-shaped supporting member also functions as a fixing member that fixes a refrigerant pipeline arranged on the rear side of the air conditioner.

22. The installing device according to claim 21, wherein the installation plate has a function to determine an installation position of the air conditioner on the wall face and a penetrating position of the refrigerant pipeline extending from the air conditioner to an outside through the wall face.

23. The installing device according to claim 22, wherein each of the plurality of mounting holes is a slit forming a knock-out hole portion disposed in the installation plate so as to determine the penetrating position of the refrigerant pipeline extending to the outside.

24. The installing device according to claim 19, wherein the adjustment mechanism is a supporting member disposed on the rear side of the air conditioner and constituted telescopically and has one end fitted in a mounting hole formed in the installation plate, and by adjusting a length of the supporting member, the flip-up height of the air conditioner can be changed.

25. The installing device according to claim 24, wherein the supporting member is constituted by a first supporting tool and a second supporting tool that slides and is engaged with the first supporting tool.

* * * * *